US012662745B2

(12) United States Patent
Kiggins et al.

(10) Patent No.: US 12,662,745 B2
(45) Date of Patent: Jun. 23, 2026

(54) METHODS FOR EXTRACTING LITHIUM FROM SPODUMENE

(71) Applicant: XERION ADVANCED BATTERY CORP., Kettering, OH (US)

(72) Inventors: Chadd Kiggins, Dayton, OH (US); John Cook, Beavercreek, OH (US); Mehmet Nurullah Ates, Kettering, OH (US); John Busbee, Beavercreek, OH (US); Brian Lee, Beavercreek, OH (US)

(73) Assignee: XERION ADVANCED BATTERY CORP., Kettering, OH (US)

( * ) Notice: Subject to any disclaimer, the term of this patent is extended or adjusted under 35 U.S.C. 154(b) by 0 days.

(21) Appl. No.: 18/537,913

(22) Filed: Dec. 13, 2023

(65) Prior Publication Data

US 2024/0301578 A1 Sep. 12, 2024

Related U.S. Application Data

(63) Continuation of application No. 16/900,089, filed on Jun. 12, 2020, now abandoned.

(60) Provisional application No. 62/865,057, filed on Jun. 21, 2019.

(51) Int. Cl.

| | |
|---|---|
| ***C25C 1/00*** | (2006.01) |
| ***C22B 26/12*** | (2006.01) |
| ***C25C 1/02*** | (2006.01) |
| ***C25C 3/02*** | (2006.01) |

(52) U.S. Cl.
CPC ..... *C25C 1/02* (2013.01); *C22B 26/12* (2013.01); *C25C 3/02* (2013.01)

(58) Field of Classification Search
CPC ..... C25C 1/02; C25C 3/02
See application file for complete search history.

(56) References Cited

U.S. PATENT DOCUMENTS

| | | | |
|---|---|---|---|
| 4,455,202 | A | 6/1984 | Sintim-Damoa |
| 9,780,356 | B2 | 10/2017 | Zhang |
| 2014/0291161 | A1 | 10/2014 | Awazu |
| 2014/0373683 | A1 | 12/2014 | Boudreault |

(Continued)

FOREIGN PATENT DOCUMENTS

| | | |
|---|---|---|
| BR | 112021025730 | 3/2022 |
| JP | 2012046794 A | 3/2012 |

(Continued)

OTHER PUBLICATIONS

Tran, Tam et al., "Lithium Production Processes", Science Direct, Lithium Process Chemistry, Chapter 3, pp. 81-124, Elsevier, Inc., 2015, http://dx.doi.org/10.1016/B978-0-12-801417-2.00003-7.

(Continued)

*Primary Examiner* — Zulmariam Mendez
(74) *Attorney, Agent, or Firm* — O'BANION & RITCHEY LLP; John P. O'Banion

(57) ABSTRACT

Systems and methods for extracting lithium metal ions from a lithium containing ore such as spodumene or lithium salts are provided. The lithium ore or salt is suspended in a hydroxide salt or eutectic and heated to produce a molten salt suspension that is used to electroplate lithiated transition metal oxides on an electrode. Lithium metal or lithium ions can be isolated from the deposited lithiated transition metal oxides. A second metal ore may be included in the suspension and processed with the lithium ore.

9 Claims, 18 Drawing Sheets

(56) References Cited

U.S. PATENT DOCUMENTS

| | | | |
|---|---|---|---|
| 2016/0028081 | A1 | 1/2016 | Zhang |
| 2017/0077490 | A1 | 3/2017 | Zhang |
| 2018/0366723 | A1 | 12/2018 | Shen |
| 2019/0100850 | A1 | 4/2019 | Ates |

FOREIGN PATENT DOCUMENTS

| | | | |
|---|---|---|---|
| KR | 1020160076021 | A | 6/2016 |
| TW | 201725773 | A | 7/2017 |
| WO | 8908723 | A1 | 9/1989 |
| WO | 2018082961 | | 5/2018 |
| WO | 2018082961 | A1 | 5/2018 |

OTHER PUBLICATIONS

ISA/KR, Korean Intellectual Property Office (KIPO), International Search Report and Written Opinion issued Sep. 17, 2020, related PCT international application No. PCT/US2020/037451, pp. 1-16, claims searched, pp. 17-20.

Canadian Intellectual Property Office (Cipo), Office Action Issued on Nov. 22, 2022, for related Canadian Patent Application No. 3,143,966 (pp. 1-3) with claims examined (pp. 4-7).

Zhang, Huigang, et al., "Electroplating lithium transition metal oxides", Science Advances, vol. 3, No. 5, May 2017, pp. 1-8.

European Patent Office (EPO), Communication (Extended European Search Report) issued Jun. 14, 2023, related European patent application No. 20825417.7, pp. 1-8, claims searched, pp. 9-12.

Taiwan Patent Office, official action dated Jan. 23, 2024, related Taiwanese patent application No. 109120271, Taiwanese-language document, pp. 1-4, English-language translation, pp. 5-8, Taiwanese-language search report, pp. 9-9, English-language translation, pp. 10-10, with claims examined, pp. 11-14.

Brazilian Patent Office, Written Opinion issued Dec. 5, 2024, related Brazilian patent application No. BR112021025730-6, Brazilian-language document, pp. 1-6, English-language document, pp. 7-7, with claims examined, pp. 8-11.

IP Australia, Examination Report No. 1 issued May 9, 2025, related Australian patent application No. 202095365, pp. 1-5, with claims examined, 6-9.

Mexican Patent Office, official action issued Sep. 3, 2025, related Mexican patent application No. MX/a/2021/015987, Spanish-language document, pp. 1-6, English-language translation, pp. 7-10, with claims examined, pp. 11-14.

Mexican Patent Office, official action issued Feb. 12, 2026, related Mexican patent application No. MX/a/2021/015987, Spanish-language document, pp. 1-6, English-language translation, pp. 7-12, with claims examined, pp. 13-16.

$\alpha$ -Spodumene

Hydroxide
treated $\alpha$-spodumene

Hydroxide
treated $\alpha$-spodumene

Spodumene

Heat Treated Spodumene

β-Spodumene

Hydroxide
treated β -spodumene

Hydroxide
treated $\beta$ -spodumene

METHODS FOR EXTRACTING LITHIUM FROM SPODUMENE

CROSS-REFERENCE TO RELATED APPLICATIONS

This application is a continuation of U.S. patent application Ser. No. 16/900,089 filed on Jun. 12, 2020, incorporated herein by reference in its entirety, which claims priority to, and the benefit of, U.S. provisional patent application Ser. No. 62/865,057 filed on Jun. 21, 2019, incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

This technology pertains generally to ore processing and metal extraction methods, and more particularly to systems and methods for extracting lithium metal ions from a lithium containing ores or from lithium salts.

2. Background

Lithium metal, and lithium metal ions ($Li^+$), are used in a variety of applications, most notably batteries, glass and ceramics. The growing market demand for lithium is mainly due to its use in the manufacture of batteries for electric or hybrid vehicles and portable electronics such as cellphones, tablets, and power tools.

While lithium can be derived from a variety of sources, the primary source of lithium is lithium-bearing pegmatite silicates including spodumene, lepidolite and petalite. Spodumene ore is most widely exploited mineral source of lithium. Spodumene is a lithium aluminum silicate ($LiAlSi_2O_6$) ore that contains approximately 3.73% lithium. Because lithium aluminum silicate is bonded covalently it is difficult decompose the structure and extract the desired lithium product. Consequently, conventional extraction techniques are complex and costly.

Conventional extraction techniques typically employ processing steps that include: (a) forming a spodumene concentration; (b) extracting lithium from the spodumene (acid or base); (c) purifying the extracted lithium (e.g., removing impurities such as Fe, Mn, Zn, Ca, Mg, Al, etc.); and (d) forming a lithium hydroxide material or a lithium carbonate material.

According to the foregoing processing techniques, after the spodumene concentrate is formed, the spodumene is heat treated at about 1100° C. in air to convert the alpha phase (spodumene concentrate) to the beta phase. This heat treatment causes the crystal structure to change from a monoclinic structure to a tetragonal structure accompanied by an approximate 30% volume expansion and approximate tenfold increase in surface area. This leads to a significant increase in leachability of the lithium from spodumene.

Next, for example, the spodumene is roasted in sulfuric acid to leach the lithium out of the structure through a process called ion-exchange where the lithium is replaced by an acidic proton allowing the lithium-ion to migrate into the aqueous solution forming lithium sulfate. However, the resulting product after sulfuric acid roasting is low purity lithium sulfate. The typical impurities are (Fe, Mn, Zn, Ca, Mg, Al, etc.). This lithium concentrate cannot be used directly to synthesize lithium metal oxides such as lithium cobalt oxide, lithium nickel oxide, lithium nickel manganese oxide, lithium nickel cobalt aluminum oxide, and other industrial useful lithium transition metal oxide energy storage materials using commercialized solid-state synthesis processes.

Common industrial solid-state synthesis methods cannot use this impure preliminary leach because a) sulfates are unsuitable for this type of solid-state reaction, and b) the impurities would end up in the material causing degradation and safety issues to the resultant batteries made from this material. Therefore, the Li-sulfate is typically purified by selective precipitation and ion exchange. This is repeated several times until the impurities are sufficiently removed for the desired applications. The purified lithium sulfate is then converted to a hydroxide or carbonate form using commercially accepted methods.

As noted above, lithium extraction from spodumene typically involves use of an acid or base. This process can be illustrated in an entry from the USDI Minerals Handbook (1995): "Extracting lithium from spodumene entails an energy-intensive chemical recovery process. After mining, spodumene is crushed and undergoes a floatation beneficiation process to produce concentrate. Concentrate is heated to 1,075° C. to 1,100° C., changing the molecular structure of the mineral, making it more reactive to sulfuric acid. A mixture of finely ground converted spodumene and sulfuric acid is heated to 250° C., forming lithium sulfate. Water is added to the mixture to dissolve the lithium sulfate. Insoluble portions are then removed by filtration. The purified lithium sulfate solution is treated with soda ash, forming insoluble lithium carbonate that precipitates from solution. The carbonate is separated and dried for sale or use by the producer as feedstock in the production of other lithium compounds."

The use of alkaline processing to recover the lithium contained in pegmatite minerals, such as spodumene, can have advantages over the acid process currently employed, especially by allowing the replacement of expensive inputs—like sulfuric acid ($H_2SO_4$) and soda ash ($Na_2CO_3$)—with less expensive limestone ($CaCO_3$) or hydrated lime ($Ca(OH)_2$. However, basic extraction of lithium with calcium carbonate (non-aqueous roasting) can also be used but this is typically a more energy intensive process that is usually carried out at between 825° C. to 1,050° C.

In order to provide high performance characteristics, lithiated transition metal oxides used for Li-ion battery fabrication typically must have a purity of about 99.5% or higher. This purity standard adds significant cost to processing lithium containing materials. Because lithium-ion battery cathodes and electrolyte currently represent the most significant cost fraction of the total battery, there is a significant interest from industry and governments to reduce the cost of the lithium purification processes. Reducing the cost of lithium production could profoundly reduce the overall cell cost leading to lower barriers for mass adoption of electric vehicles as an example.

One conventional method for the manufacture of lithium ion batteries requires synthesis of an active powder, followed by mixing the electrochemically active powder with conductive agents such as carbon black and a binder (e.g., polyvinylidene fluoride) to form a composite slurry, and casting the slurry onto the surface of a current collector, typically a planar (i.e., a two-dimensional surface). A continuous electron pathway is based on the connection of conductive agent, electrochemically active particles, and current collectors. Bending or twisting the battery, however, could loosen the particle connection and lead to the apparent capacity loss. Due to the intrinsic limitation of powder size, slurry preparation, casting process, and the usage demands, it appears unlikely that this conventional method will be capable of satisfying the evolving demands of evolving consumer electronics for more complex shapes, flexibility and greater energy density per unit area.

Accordingly, there is a need for alternative lithium extraction methods that are simple, industrially scalable and lower in cost than conventional methods. There is also a need for lithium battery electrodes with lithiated transition metal oxides that are easy and inexpensive to manufacture.

BRIEF SUMMARY

Systems and methods for extracting lithium from lithium containing ores such as spodumene ore and other lithium sources are provided. The methods can also be used to selectively electroplate metals that may be present in the processed ores or other source materials that are considered impurities. In one embodiment the lithium is extracted from alpha spodumene ores or concentrate. In another embodiment, alpha spodumene is converted to beta spodumene and lithium is extracted from the beta spodumene. In another embodiment, beta spodumene is spodumene is roasted in sulfuric acid prior to lithium extraction. In each of the foregoing methods the resultant product, using a molten salt eutectic process, is a lithiated transition metal oxide such as lithium cobalt oxide ($LiCoO_2$) in powder form or in final electrode form, which is also referred to "electroplated LCO." Although electroplating of LCO is used to illustrate the processes, many other active transition metal oxide materials (e.g. NMC, LTO, NCA, LMO) and metals (e.g. Ni, Co, Mn) can be electroplated using the described methods as well.

The technology described herein is intended to eliminate the standard commercial steps of lithium extraction and purification. The conventional process for forming high purity LiOH and $Li_2(CO)_3$ from spodumene consists of three major sets of processing steps: 1) spodumene concentration, 2) lithium extraction, and 3) purification. Spodumene concentration begins with multiple particle miniaturizing and separation steps, such as: crushing, screening, dense media separation, grinding, flotation, and belt filtration. The second set of processes consist of extracting lithium from spodumene through decrepitation at 1050° C. and roasting in sulfuric acid. The third process involves the purification and chemical conversion of $LiSO_4$ to either LiOH or $Li_2(CO)_3$. In comparison, the decrepitation and numerous precipitation and ion exchange steps are eliminated with the present technology. In fact, the lithium-ion extraction process is much simpler than conventional processing procedures.

The source material is preferably a lithium containing pegmatite ore such as spodumene. However, the methods may be adapted for use with other metal extractions and other types of ore. While alpha-spodumene is a common lithium-containing ore, the lithium source can comprise, lepidolite, petalite, amblygonite, hectorite, beta-spodumene and eucryptite ores as well as mixtures of ores and concentrates, for example. The methods may also use recycled salts, lightly refined ores, lower purity concentrates and other lithium containing materials as a source or to supplement the lithium extractions and the electroplating processes.

The methods use a molten salt or eutectic process in the extractions. Suitable eutectics exist including: LiOH, KOH, NaOH, RbOH, CsOH, LiCl, LiF, KF, KCl, NaCl, NaF, LiBr, NaBr, KBr, $AlCl_3$, ZnCl, $LiNO_3$, $NaNO_3$, $KNO_3$, $LiNO_2$, $NaNO_2$, $KNO_2$, $Li_2SO_4$, $Na_2SO_4$, $K_2SO_4$, that are heated beyond the melting point of the salt to form a liquid-spodumene-solid molten salt suspension (about 20° C. to about 1100° C.°) where it is leached for 1-16 hours as needed.

In general, temperatures substantially in excess of 750° C. are used in the molten salt process are less preferred. Operating temperatures may be less than 750° C., less than 650° C. or even less than 500° C. In some embodiments, for example, the electrodeposition temperature will be in the range of 50° C. to 750° C. or 100° C. to 600° C., or 200° C. to 600° C., 200° C. to 500° C., 250° C. to 600° C., or even 300° C. to 500° C.

The eutectic process can be used to electrodeposit pure lithiated transition metal oxides onto an electrode. The thickness of the LCO electrode deposit is preferably between approximately 25 μm and 100 μm. However, the typical deposit may be in the range of approximately 10 nm to 5 mm. The density of the electrode is expected to be in the range of about 25% to 100%.

While the lithiated transition metal oxide LCO is used as an illustration of the methods, other lithiated transition metal oxides can be electroplated using the methods. For example, other structures may include lithium manganese oxide spinel ($LiMn_2O_4$) (LMO); lithium iron phosphate ($LiFePO_4$) (LFP); lithium titanate ($Li_4Ti_5O_{12}$) (LTO) and nickel cobalt aluminum oxide (NCA). For example, the lithiated transition metal oxide can be $LiNiaMnbCo_{1-a-b}O_2$ (NMC), where a is greater than 0 and less than about 1, b is greater than 0 and less than about 1, and a+b is greater than 0 and less than about 1.

According to one aspect of the technology, a simple and effective method is provided to process lithium containing ores, concentrates and recycled materials and to produce lithium metal oxides and other useful materials.

Another aspect of the technology is to provide a lithium extraction and electroplating method and system that allows extraction and electrodeposition to take place in a single reactor vessel.

A further aspect is to provide a method of electrode formation with a coating of lithiated transition metal oxide. Advantageously, electrodeposition of transition metal oxides using molten salts for use as an electrode in a primary or secondary battery obviates the need for combining a powder of the transition metal oxide composition with a binder and conductive material to form a paste, and then molding or otherwise applying the paste to a current collector or other structure.

Another aspect of the present technology is to provide a method of extracting lithium metal ions from a lithium containing ore or from lithium salts with a molten salt or eutectic process with salts including metal hydroxides, nitrates, nitrites, carbonates, sulfates, and chlorides.

A further aspect is to provide a method of extracting metal ions from starting combinations of two or more metal ores such as nickel, copper, cobalt, and manganese-based ores and then sequentially electroplating metal oxides or refining metals.

Another aspect of the present technology is a method of forming a lithiated transition metal oxide electrodes or powders comprising the steps of (i) immersing a working electrode into a non-aqueous electrolyte comprising a lithium source and a transition metal source, (ii) electrodepositing a lithiated transition metal oxide onto a surface of the working electrode from the electrolyte at a temperature in excess of the melting temperature of the non-aqueous electrolyte, (iii) removing the working electrode from the bath and (iv) rinsing the electrodeposited lithiated transition metal oxide.

A further aspect of the present disclosure is a primary or secondary battery comprising a lithiated transition metal oxide prepared by an electrodeposition method disclosed herein.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWINGS

The technology described herein will be more fully understood by reference to the following drawings which are for illustrative purposes only.

DETAILED DESCRIPTION

Referring more specifically to the drawings, for illustrative purposes, compositions and methods for the processing of lithium containing pegmatite minerals, such as spodumene, to produce lithiated transition metal oxides such as lithium cobalt oxide ($LiCoO_2$) in powder form or in final electrode form, for use for lithium battery applications etc. are generally shown. Several embodiments of the technology are described generally in FIG. 1 to FIG. 11 to illustrate the characteristics and functionality of the framework compositions, system processes and methods. It will be appreciated that the methods may vary as to the specific steps and sequence and the systems and apparatus may vary as to structural details without departing from the basic concepts as disclosed herein. The method steps are merely exemplary of the order that these steps may occur. The steps may occur in any order that is desired, such that it still performs the goals of the claimed technology.

Figure 1:
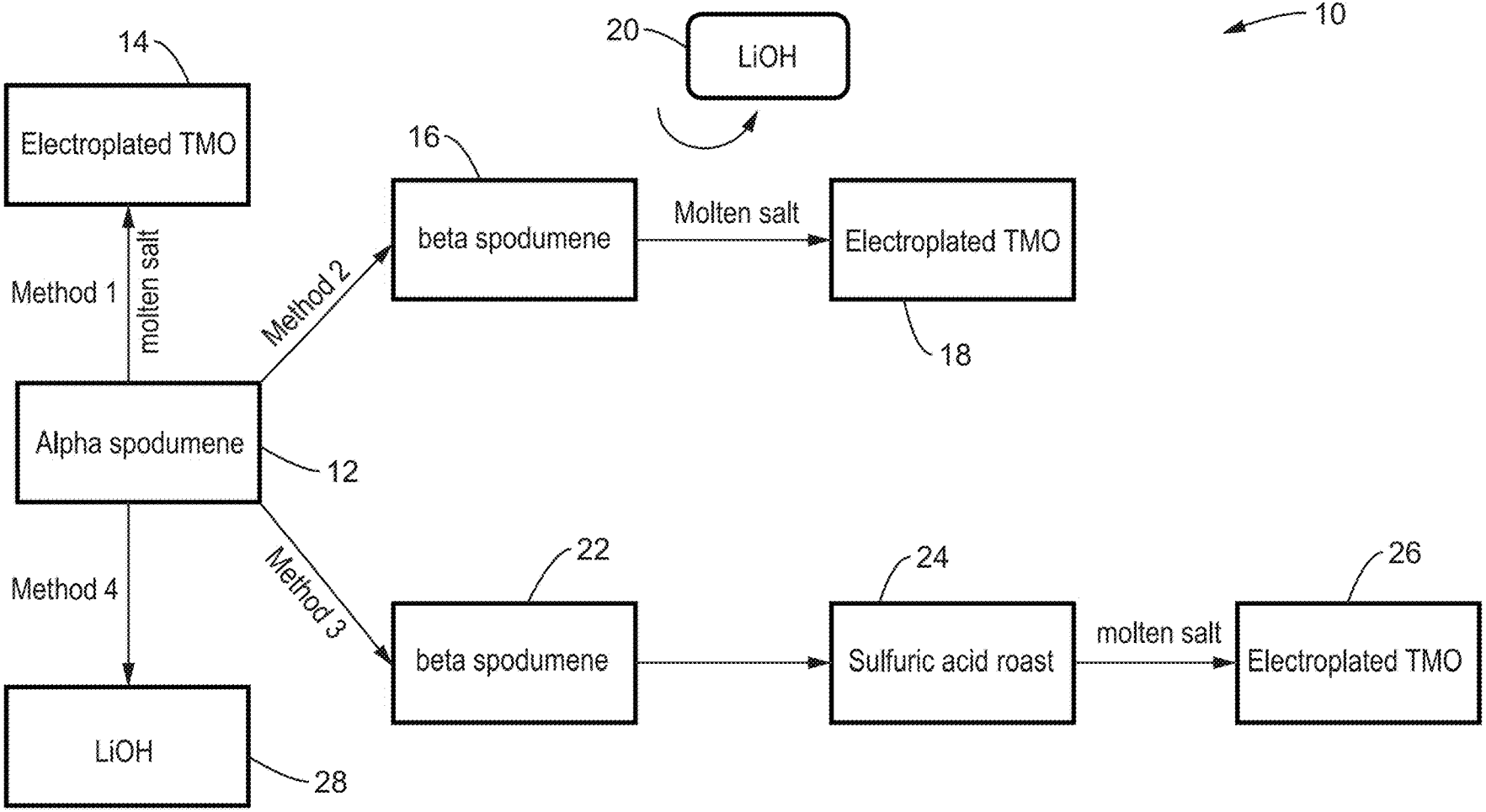
FIG. 1 is a schematic block flow diagram illustrating four methods for lithium extraction according to embodiments of the presented technology.

Turning now to FIG. 1, methods 10 for processing alpha-spodumene source material to produce lithium oxide or electroplated lithium cobalt oxide is shown schematically and is used to illustrate the technology. Although spodumene and are illustrated, it will be understood that the processes and methods can be adapted to utilize other lithium containing source materials and produce other final lithium-based products.

The processes for extracting lithium from spodumene shown in FIG. 1 begin with a source material 12, such as spodumene ore. The methods reduce the number of steps required in standard commercial lithium extractions and purifications. In particular, the presented technology eliminates the decrepitation and numerous precipitation and ion exchange steps and the lithium-ion extraction processes are much simpler than found in conventional processing.

The lithium containing material is preferably provided in the form of an alpha-spodumene ore or concentrate 12. The spodumene source material 12 is preferably raw spodumene ore that may be used directly out of the ground to optionally bypass the conventional concentrating steps and reduce overall processing costs. In this embodiment, the use of raw ore may lead to significant insoluble material remaining in the molten salt that can be filtered using a flow system. The insoluble material settles out in a separate tank and removed using established commercial methods.

In another embodiment, minimal processing such as crushing, screening and dense media separation could be employed. However, minimal processing may not be needed but may advantageous if, for example, lightly processed spodumene is what is available and most cost effective in an open market at the specific time of processing.

Alternatively, the spodumene could be concentrated to low purity $Li_2SO_4$ in a conventional manner or other commercially available lithium containing ores or concentrates. Lithium salts of various compositions may also be used alone or in combination with lithium containing ores as lithium source materials. Lithium salts from natural or recycled sources include lithium chloride, lithium carbonate, lithium sulfide, lithium phosphate and lithium nitrate.

The foregoing are examples only and not intended to limit the source of lithium containing ore that is used for lithium extraction. While alpha-spodumene is a common ore, the lithium-containing ore can comprise, lepidolite, petalite, amblygonite, hectorite, beta-spodumene and eucryptite as well as mixtures of lithium ores, for example. In some embodiments, a second metal ore is added to the initial lithium ore material for extraction. The second metal ore may be ore of individual metals or combinations of metals. Preferred second ores include nickel, copper, cobalt and manganese-based ores and combinations such as CoCu, $Co_2CuS_4$, and $(Cu_2CO_3(OH)_2$.

The schematic flow diagram of FIG. 1 depicts four process methods for the production of either LiOH or a lithiated transition metal oxide in powder form or in final electrode form, which is identified as "electroplated TMO" in FIG. 1. Lithium metal ions can also be isolated from the deposited oxide. Each process is described in greater detail below.

One embodiment designated as Method 1, uses alpha-spodumene ore to directly produce the final products 14 with a single processing step using a molten salt such as potassium hydroxide (KOH) to extract the lithium from the spodumene into a molten salt eutectic that can be used to electrodeposit pure lithiated transition metal oxides 14. Although hydroxide salts are preferred other salts such as nitrates, nitrites, carbonates, sulfates and chlorides can also be used. For example, suitable salts and combinations of salts forming eutectics include: LiOH, KOH, NaOH, RbOH, CsOH, LiCl, LiF, KF, KCl, NaCl, NaF, LiBr, NaBr, KBr, $AlCl_3$, ZnCl, $LiNO_3$, $NaNO_3$, $KNO_3$, $LiNO_2$, $NaNO_2$, $KNO_2$, $Li_2SO_4$, $Na_2SO_4$, $K_2SO_4$, and combinations of thereof.

As a result of the chemical interaction of the molten salt/eutectic extraction media with alpha-spodumene, the process is substantially faster and demonstrates high extraction efficiencies. In one embodiment, a molten salt that is substantially void of water is used. The merit of using a molten salt or eutectic compared to the previous methods that also use basic media is the reduction of the number of processing steps, higher extraction efficiency, and higher extraction rates.

This embodiment facilitates generating electrodes from the same extraction bath, which increases the yield and reduces manufacturing complexity. Once the lithium is removed from the ore in the molten salt, the lithium contained within the molten-salt extraction media can be used directly (preferred) or the lithium can be minimally processed to synthesize lithium transition metal oxides using standard solid-state synthesis methods (e.g., without limitation, LCO). Accordingly, spodumene ore can effectively be used for direct production of high purity lithium salts, Li-ion battery active material powders for use in with traditional slurry-based electrode manufacture as well as electroplated electrodes.

Compared to conventional extraction methods, the initial decrepitating step (>1050° C.) and the sulfuric acid roasting steps are eliminated. Although the basic (pH>7) extraction media of conventional processes is still used by this method, the process is carried out at a lower temperature than used by conventional techniques and in a non-aqueous environment.

In the method designated as Method 2, the source material is either alpha-spodumene 12 that is converted to beta-spodumene or beta-spodumene ore 16 is used directly to product the final electrodeposited transition metal oxide products 18 using a molten salt step, preferably with a lithium hydroxide salt.

The embodiment designated as Method 3 has the most steps and takes the most time for processing the spodumene, yet still reduces the total number of steps by at least ten steps, which significantly reduces the time to produce and the cost of the resultant material compared to conventional processes. In Method 3, the source material may be alpha spodumene 12 that is converted to beta spodumene 22 or a source of beta spodumene ore or concentrate 22. The beta spodumene 22 is roasted with a sulfuric acid roast 24 and that material is then electroplated at block 26 using the molten salt process.

Method 4 of FIG. 1 has both an extraction step and a physical separation step preferably yielding LiOH as the final product 28. In FIG. 1, the resultant product 28 is either LiOH, or a lithiated transition metal oxide such as lithium cobalt oxide ($LiCoO_2$) in powder form or in final electrode form. By extension, other lithiated transition metal oxides (e.g. LMO, NCA, NMC, LFP, LTO) can be electroplated using this method. For example, the lithiated transition metal oxide could comprise $LiNiaMnbCo_{1-a-b}O_2$ (NMC) where a is greater than 0 and less than about 1, b is greater than 0 and less than about 1, and a+b is greater than 0 and less than about 1.

The lithium hydroxide produced with Method 4 can be used in other processes such as the hydroxide 20 used with the processing of beta-spodumene of Method 2 depicted schematically in FIG. 1. Alternatively, the lithium hydroxide product 28 can be chemically processed further to produce other industrially or commercially desirable lithium containing feedstocks. For example, the lithium-containing products can comprise lithium acetate, lithium bicarbonate, lithium carbonate, lithium chloride, lithium citrate, lithium fluoride, lithium stearate, lithium citrate and others. If $Li_2CO_3$ is desired, as it is for the conventional manufacture of certain lithiated transition metal oxides, the LiOH could be converted to $Li_2CO_3$ using established commercial methods.

The production of an electroplated product such as an electrode preferably occurs in the non-aqueous extraction bath of the lithium source and transition metal hydroxide source to electrodeposit a lithiated transition metal oxide onto the surface of the working electrode. The plated electrode may be removed from the bath and rinsed for further use.

Accordingly, the present technology simplifies and eliminates many of the steps of the standard commercial steps of lithium extraction and purification such as the decrepitation and numerous precipitation and ion exchange steps. The extraction processes are also less costly than more complex conventional processing schemes.

The technology described herein may be better understood with reference to the accompanying examples, which are intended for purposes of illustration only and should not be construed as in any sense limiting the scope of the technology described herein as defined in the claims appended hereto.

Example 1

In order to demonstrate the operational principles of the technology, the lithium ion extraction and electrodeposition of lithium transition metal oxides according to Method 1 shown in FIG. 1 was conducted. In this illustration, lithium cobalt oxide ($LiCoO_2$) was produced by electrodeposition on an electrode and evaluated.

The method extracted lithium directly from alpha spodumene ore. The base ore material was 235 g of alpha spodumene concentrate with 3.36% Li by mass (assay by ICP using hydrofluoric acid digestion). The particle size was approximately 50 μm was preferred but particle sixes ranging from 10 nm to 5 mm was acceptable.

However, the lithium concentration in spodumene could vary from 0.01-4% depending on its origin. The alpha spodumene concentrate was suspended in 1000 g of KOH (16:1 mole KOH:mole $LiAlSi_2O_6$), or 578 g KOH:422 g NaOH, in this example, but many other eutectics and ratios of the molten salt extraction media to spodumene could be used.

The suspensions were heated beyond the melting point of the salt to form a liquid-spodumene-solid molten salt suspension (about 20° C. to about 1100° C.°) where it was allowed to leach for 1-16 hours. In general, temperatures substantially in excess of 750° C., however, are presently less preferred and thus, the operating temperature may be less than 750° C., less than 650° C. or even less than 500° C. In some embodiments, for example, the electrodeposition temperature will be in the range of 50° C. to 750° C., 100° C. to 600° C., 200° C. to 600° C., 200° C. to 500° C., 250° C. to 600° C., or even 300° C. to 500° C.

Wet nitrogen gas was bubbled through the molten salt melt by first passing nitrogen through 1 L of deionized water at 90° C. at a flow rate 1-10 SCFH. Dry nitrogen gas could also be used. Over the course of the leaching, 200 mL to 350 mL of water was passed into the molten salt suspension. The degree of salt hydration could be varied by allowing the take-up of water to range from 0-10 liters depending on the desired reaction rate. The molten salt has sufficient chemical potential to break the covalent spodumene bonds leading to the solubilization of silicon, aluminum, and importantly lithium. The leaching method leaves the aluminum-silicate structure intact while exchanging the lithium, or in some cases may break the structure apart completely.

Figure 2A:
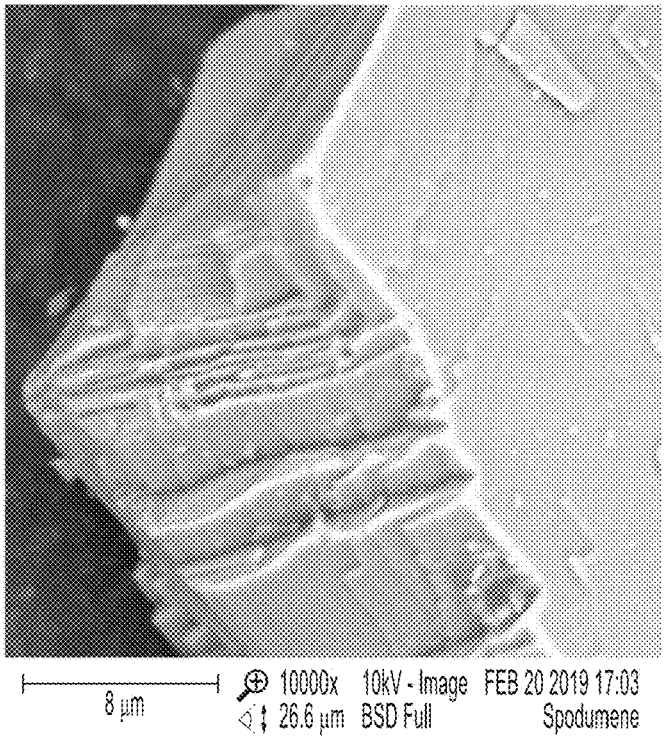
FIG. 2A is a micrograph of alpha spodumene before lithium extraction.
Figure 2B:
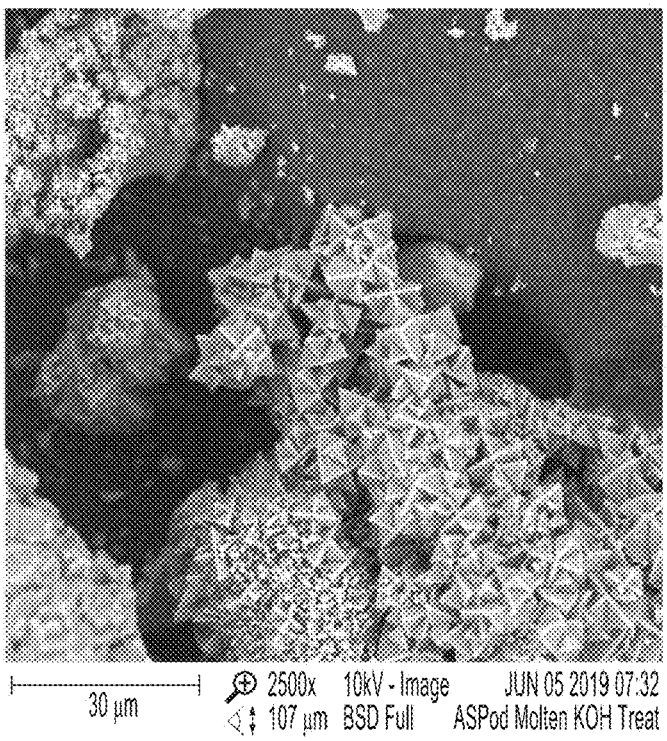
FIG. 2B is a micrograph of alpha spodumene treated with molten potassium hydroxide for lithium extraction.
Figure 2C:
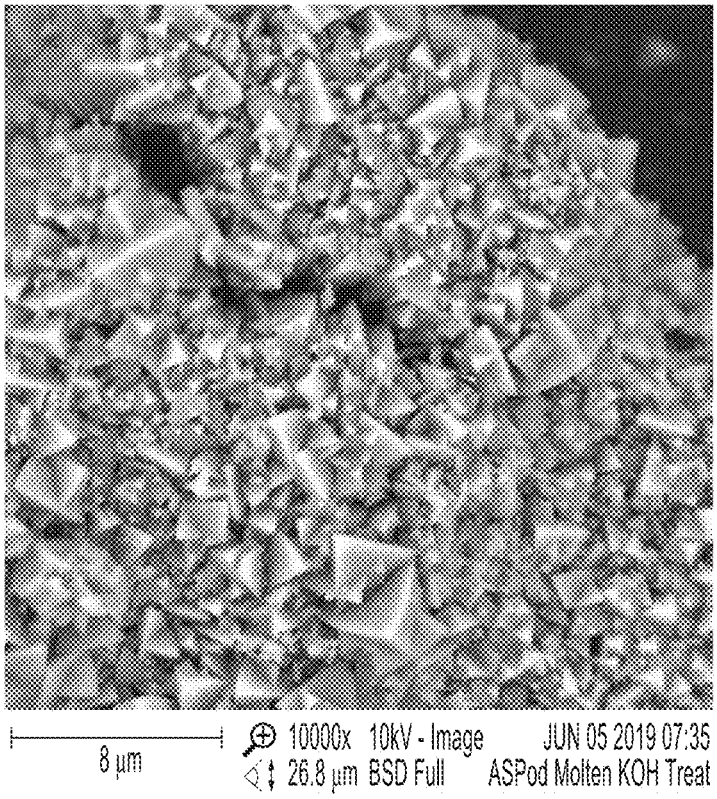
FIG. 2C is a micrograph of alpha spodumene treated with molten potassium hydroxide for lithium extraction.

FIG. 2A shows a scanning electron microscopy image of alpha spodumene before and FIG. 2B and FIG. 2C shows spodumene after extraction in molten potassium hydroxide. As evidence of the extraction process, a clear change in particle shape and morphology is observed following the hydroxide extraction shown in FIG. 2B and FIG. 2C. The extraction efficiency was 55% (assay by ICP). This was defined by the percentage of the 3.36% lithium in alpha spodumene that was extracted as a result of the leaching process.

Example 2

To demonstrate the anodic electrodeposition of transition metal oxides, the lithiated transition metal oxide ($LiCoO_2$) from lithium that was extracted from alpha spodumene in Example 1 was electrodeposited onto an electrode. In this illustration, 9 g of spodumene derived LiOH in KOH mixture was put into a nickel crucible and heated to 290° C. and about 0.5 g CoO was added to the melt. The melt color changed from white to blue as the divalent cobalt ion was coordinated by hydroxide ions. After the added CoO was totally dissolved, aluminum foil was inserted into the melt and voltage pulses (0.8V vs cobalt reference, 100 ms pulse) were applied. Between pulses, there was an open circuit voltage period (ranging from 2 to 35 seconds). No current was applied. Only open circuit voltage (OCV) was monitored. The cobalt ions in the depleted region close to the surface of aluminum foil were replenished by ion diffusion. Repeated voltage pulses and OCV periods resulted in a monolithic deposition of $LiCoO_2$ onto aluminum foil. After finishing the deposition, the $LiCoO_2$ electroplated onto the aluminum foil was taken out of the bath and rinsed with water after cooling down. The thickness of the LCO electrode was approximately 1 μm. More preferably, electrodes with thickness between 25 μm to 100 μm are desired, which can be accomplished by increasing the charge passed during the electrodeposition process. The following ranges are expected to be produced by this technology: 10 nm-5 mm. The density of the electrode ranged from approximately 25% to approximately 100%.

Figure 3A:
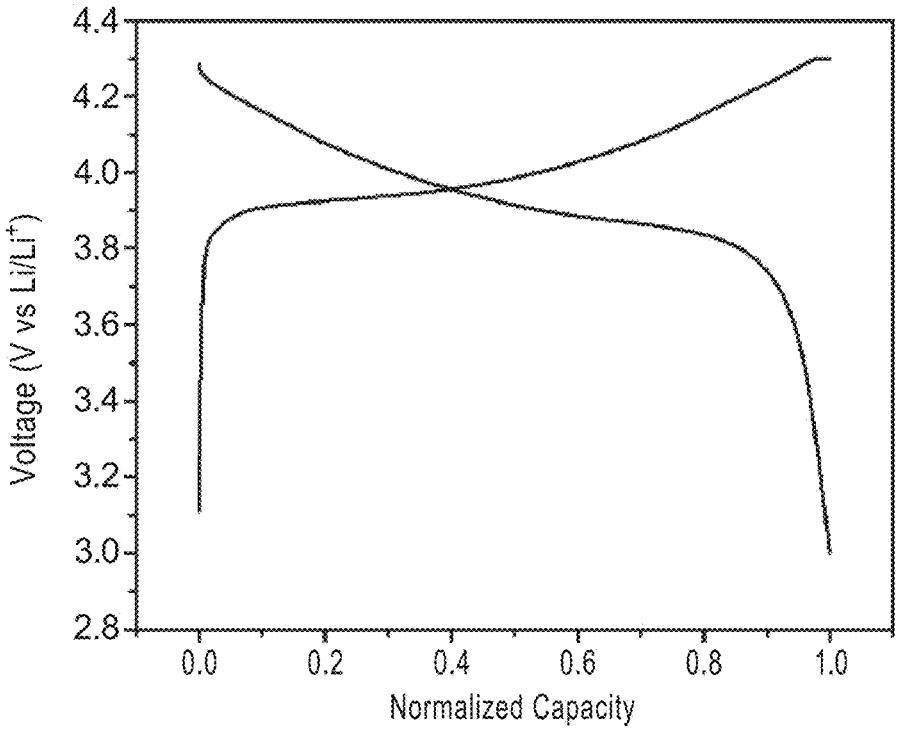
FIG. 3A is a graph of voltage vs. normalized capacity curves showing that the alpha spodumene can be directly used to electrodeposit $LiCoO_2$ cathode electrodes according to the presented technology.
Figure 3B:
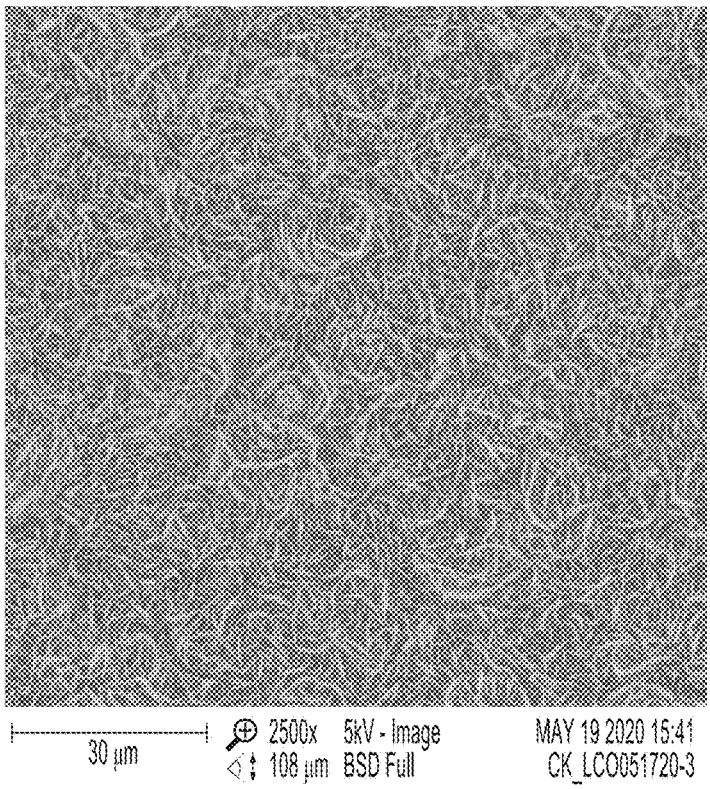
FIG. 3B is a micrograph of electrodeposited $LiCoO_2$ on a cathode electrode.
Figure 3C:
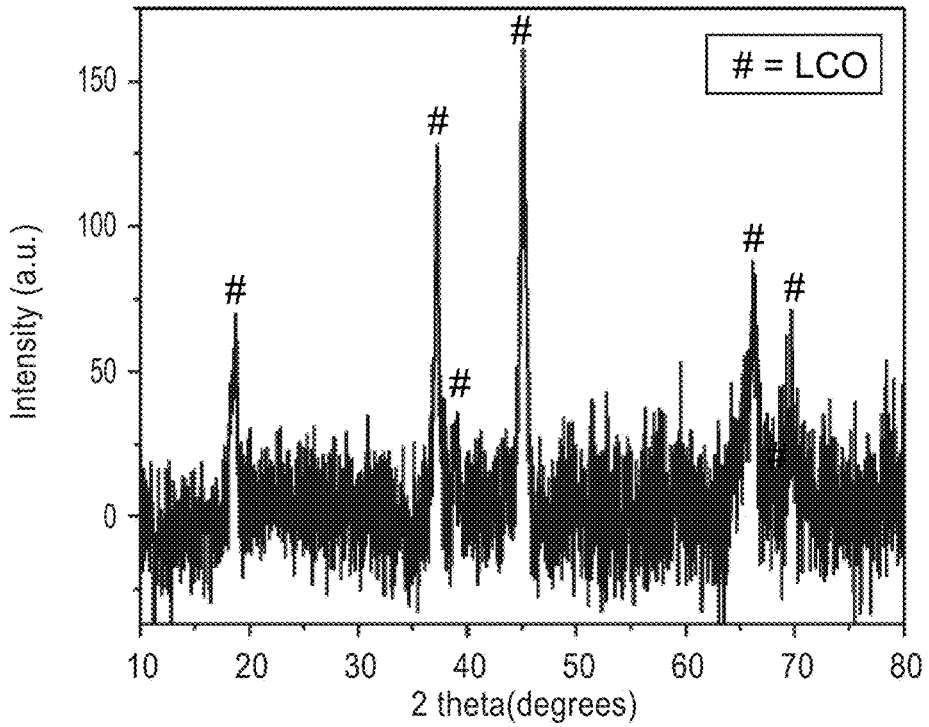
FIG. 3C is graph of powder diffraction peaks of the electroplated $LiCoO_2$.
Figure 3D:
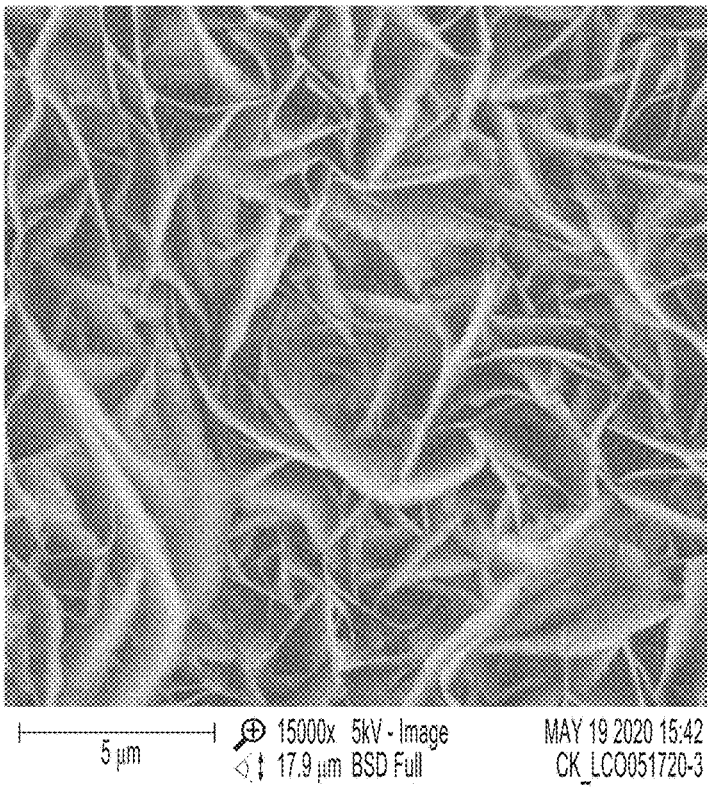
FIG. 3D is a high-resolution scanning electron microscopy image where the $LiCoO_2$ exhibits a flake-like morphology.

FIG. 3A through FIG. 3D shows the structural and electrochemical characterization of $LiCoO_2$ electroplated from the resultant molten salt solution. All diffraction peaks (FIG. 3C) can be assigned to Joint Committee on Powder Diffraction Standards (JCPDS) card no 50-0653 indicating that the materials made from alpha spodumene derived lithium precursor are crystallographically consistent to lithium cobalt oxide produced using the standard commercial solid-state synthesis method. The high-resolution scanning electron microscopy images of FIG. 3B and magnified in FIG. 3D shows the $LiCoO_2$ exhibits a flake-like morphology consistent with morphology that can be produced from high purity (>99.5) precursors such as LiOH.

The LCO formed by this method was evaluated in a half cell coin cell using the LCO as a working electrode and a lithium metal counter electrode. The cell was cycled at a charge/discharge rate of C/5 (150 mAh/g of charge was transferred in 5 hours) between 4.3-3.0V vs Li/Li+ at 22° C. using constant current/constant voltage (CCCV) cycling.

The voltage vs. normalized capacity curve shown in FIG. 3A demonstrates features that are consistent with high quality LCO.

Example 3

In another example, the decrepitation and the extraction steps were combined. This example demonstrated the method with a reduced number of steps, which decreased the total extraction time. Here, 10 g of KOH was thoroughly mixed with 8.3 g of alpha-spodumene concentrate (4:1 mol KOH:alpha spodumene) and heated to about 1100 C for about 1 hour. Lithium was removed from the structure forming LiOH. FTIR spectroscopy was performed on this resultant material which showed the formation of LiOH (characteristic peak at 1452 $cm^{-1}$). This result indicated that lithium ions were leached from spodumene.

Example 4

To demonstrate the anodic electrodeposition of transition metal oxides from the combined decrepitation and the extraction step produced from the molten salt mixture, an electrode was immersed into a non-aqueous electrolyte of a lithium source and a transition metal source at a temperature in excess of the melting temperature of the non-aqueous electrolyte to deposit the lithiated transition metal oxide onto the electrode.

Following the direct lithium extraction, the temperature of the molten salt (KOH and the resulting LiOH) was reduced to between about 100° C. and about 350° C., and 0.5-1.0 g cobalt oxide (which can be another ore or purified metal hydroxide) was added to the molten salt mixture. The melt color changed from white to blue as the divalent cobalt ion was coordinated by hydroxide ions. After the added CoO was totally dissolved, aluminum foil was inserted into the melt and voltage pulses (0.8V vs cobalt reference, 100 ms pulse) were applied. Between pulses, there was an open circuit voltage period (ranging from 2 to 35 seconds). No current was applied. Only the open circuit voltage (OCV) was monitored. The cobalt ions in the depleted region close to the surface of aluminum foil were replenished by ion diffusion. Repeated voltage pulses and OCV periods enabled a monolithic deposition of $LiCoO_2$ onto the aluminum foil. After finishing the deposition, the $LiCoO_2$ electroplated onto the aluminum foil was taken out of the bath and rinsed with water after cooling down. The advantage of this method is that the entire process occurs in one reactor.

Example 5

In another demonstration of the functionality of Method 1, alpha spodumene ore was submerged into a mixture of KOH and an additional potassium salt such as (KCl, $K_2SO_4$, or $K_2CO_3$). The salt was added to KOH in a molar ratio that is 1.5:1 molar excess to the moles of lithium oxide ($Li_2O$) present in spodumene. The anion of the alternative potassium compound may have a lower bond formation energy with lithium or a stronger dissociating energy than hydroxide, thus increasing the lithium extraction efficiency and rate. The reaction occurred at 320° C. over 4 hours and then the entire solution was cooled and dissolved in 1 liter of water. The addition of $K_2SO_4$ yielded the highest lithium extraction among the other salts and outperformed the leaching efficiency (65% vs. 55%) of pure KOH at 370° C. at the same residence time (assay by ICP).

Example 6

In order to further demonstrate the operational principles of the technology, the lithium ion extraction and electrodeposition of lithium transition metal oxides according to Method 2 shown in FIG. 1 was conducted. In this demonstration, alpha spodumene 12 was converted to beta spodumene 16 that could then be used directly to produce high purity salts and Li-ion battery electrodes.

There may be circumstances where it is more favorable to start from lightly processed beta-spodumene instead of alpha-spodumene depending on availability and market prices. In some settings, it may be easier and less expensive to purchase manufacturable quantities of beta-spodumene compared to alpha-spodumene.

Figure 4A:
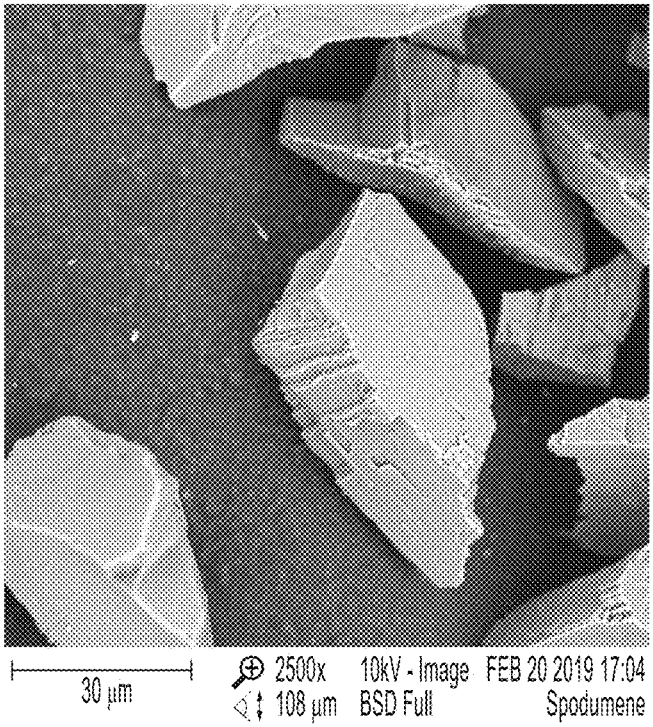
FIG. 4A is a micrograph with magnified detail of spodumene.
Figure 4A:
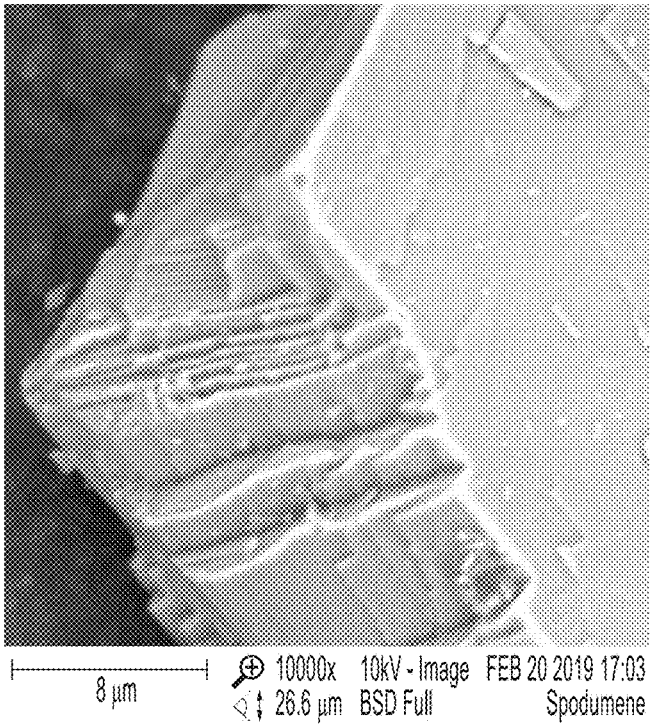
Figure 4B:
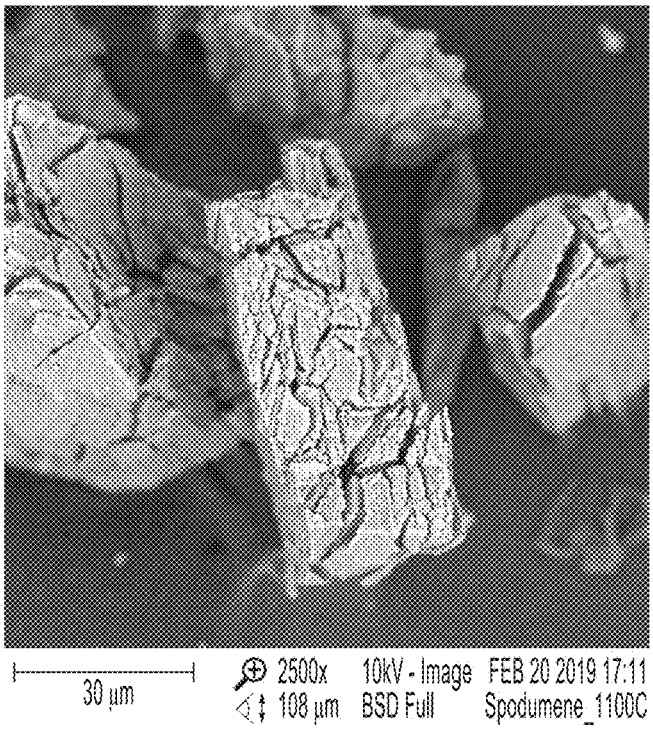
FIG. 4B is a micrograph with magnified detail of spodumene after heat treatment.
Figure 4B:
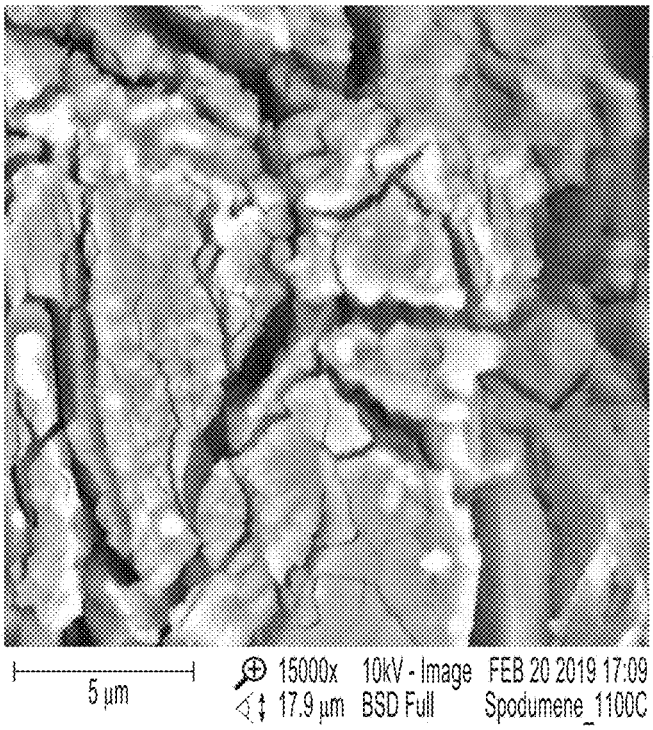
Figure 4C:
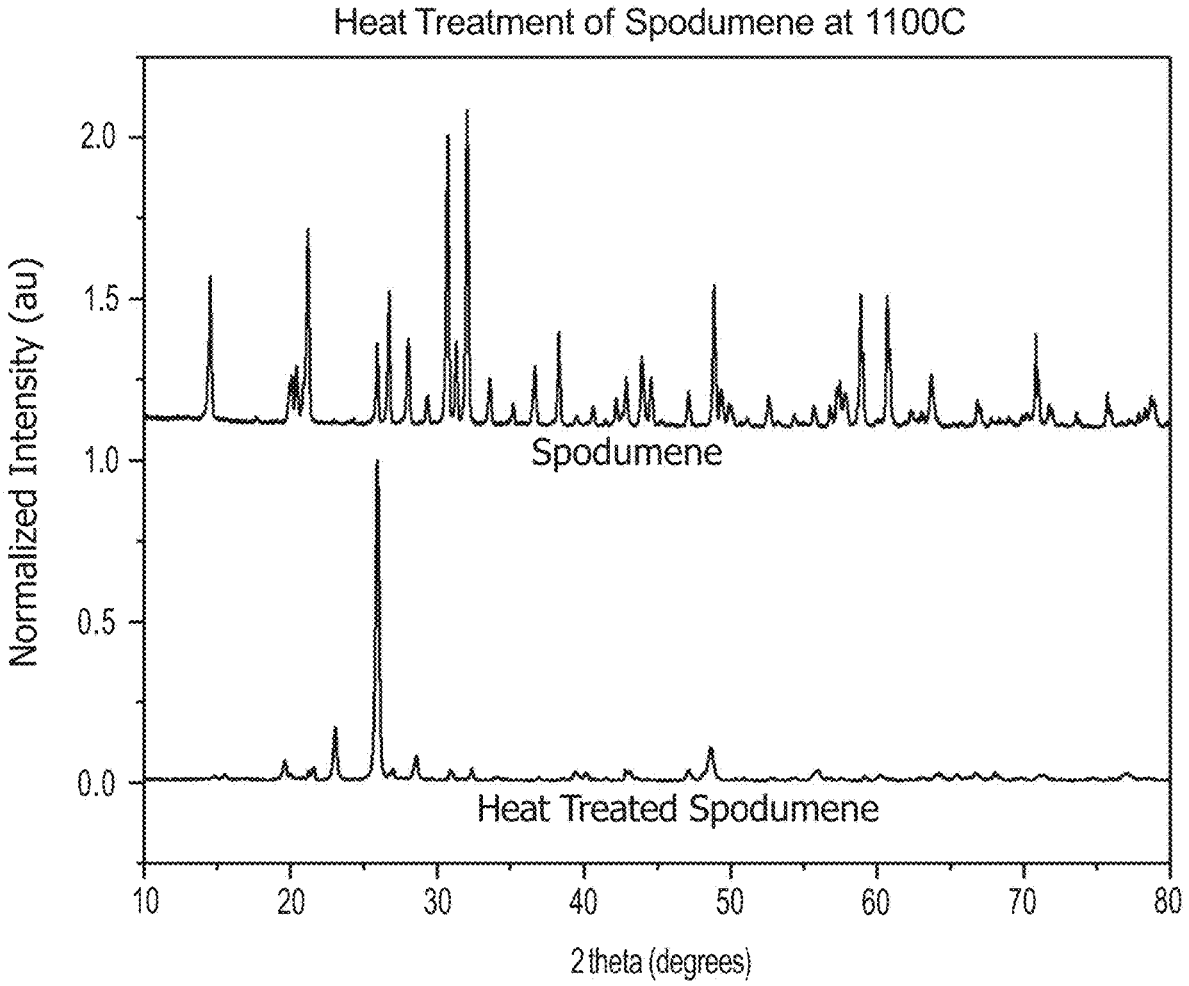
FIG. 4C is a graph of x-ray diffraction (XRD) results of alpha spodumene before and after the heat treatment of the decrepitating step.

The common commercial method for converting spodumene to LiOH employs a heat treatment step (about 1100° C. for about 1 hour) as an initial process step to convert alpha-spodumene to beta-spodumene. FIG. 4A and FIG. 4B are SEM images and FIG. 4C is an XRD pattern of alpha spodumene before (FIG. 4A) and after (FIG. 4B) the heat treatment step at 1100° C. Converting the alpha phase to the beta phase causes the crystal structure to change from the monoclinic structure to the tetragonal structure, which is evidenced by the XRD results shown in FIG. 4C. This structural conversion is also accompanied by about a 30% volume expansion and about a ten-fold increase in surface area as shown in FIG. 4B by the large density of cracks and voids present within the particles. This can lead to a significant increase (yield and rate) in leachability of the lithium from the ore.

Figure 5A:
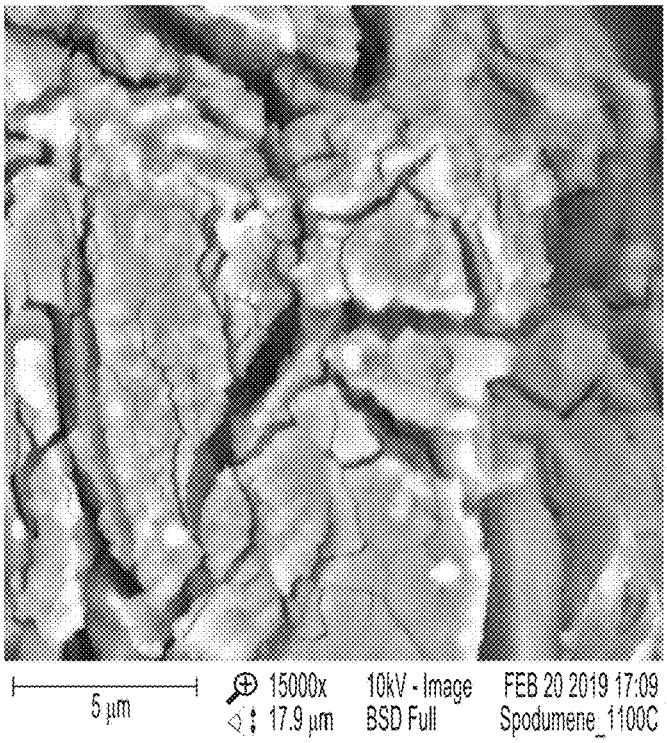
FIG. 5A is a micrograph of beta spodumene before lithium extraction.
Figure 5B:
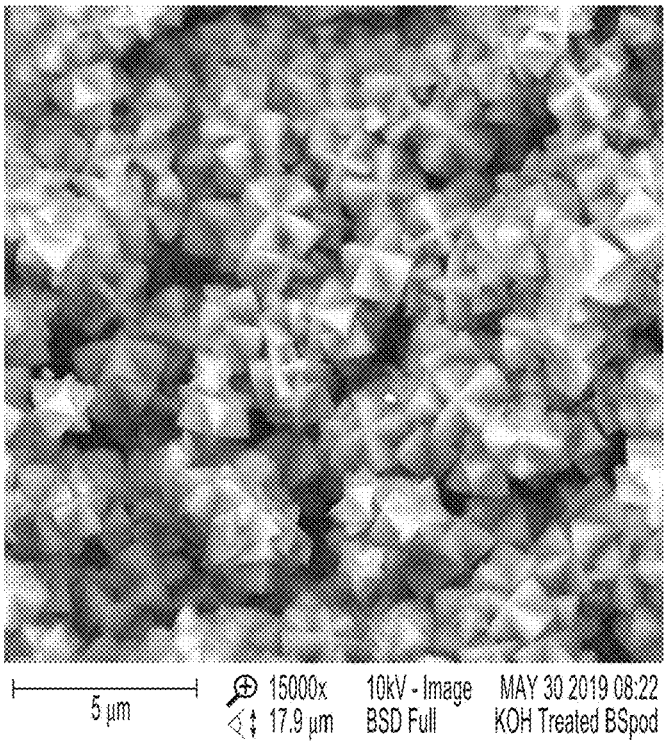
FIG. 5B is a micrograph of beta spodumene after hydroxide treatment for lithium extraction.
Figure 5C:
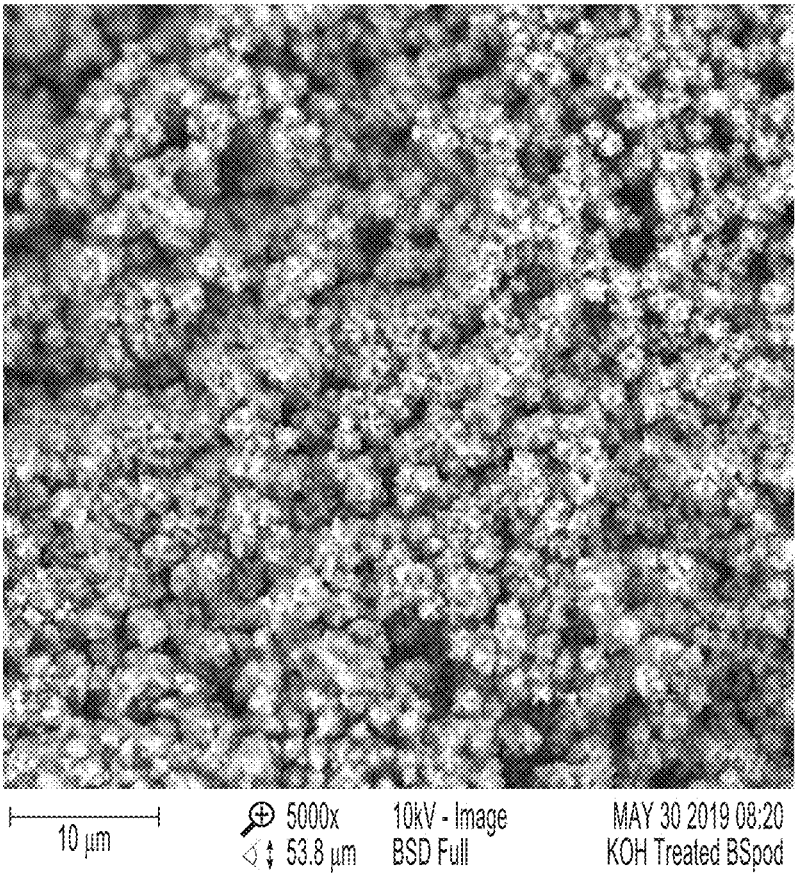
FIG. 5C is a micrograph of beta spodumene after hydroxide treatment according to one embodiment of the presented technology.

The beta phase of spodumene may be easier to leach lithium in an NaOH—KOH eutectic compared to starting with the alpha phase. However, the tradeoff is a separate heating step outside of the molten salt. The NaOH—KOH eutectic can operate at about 170° C. to about 600° C. but preferably at about 300° C. When beta-spodumene is immersed in the eutectic solution at the elevated working temperatures, lithium ions are leached into the molten salt extraction solution. Beta-spodumene without treatment is shown in the SEM micrograph of FIG. 5A. FIG. 5B and FIG. 5C are SEM images of beta-spodumene after immersion in hydroxides, similar to that of FIG. 2B, which showed a clear change in particle shape and morphology as evidence of the extraction process.

Example 7

To demonstrate the process of Method 2 further, a mixture of 50 g of beta-spodumene was added to KOH for a period of about one hour and the 160 g KOH was heated to 350° C. and held for 12 hours, during which time it bubbled vigorously indicating a chemical reaction between with the spodumene leading to the extraction of lithium-ions. After the reaction, the reaction vessel contained the desired LiOH and a suspension of solid material in the KOH melt that could be easily filtered out. After the reaction, the salt mixture was dissolved and thoroughly rinsed with water. As evidence that the extraction process has occurred, a clear change in particle shape and morphology was observed following the hydroxide immersion as depicted in FIG. 5C.

Example 8

Anodic electrodeposition of a lithiated transition metal oxide ($LiCoO_2$) from hydroxide extracted beta-spodumene was also illustrated. Alpha-spodumene was converted to beta-spodumene by roasting the alpha spodumene at 1100° C. for 1 hour. Then, 235 g of the produced beta-spodumene concentrate with 3.36% Li by mass (assay by ICP using hydrofluoric acid digestion) was suspended in 1000 g of KOH (16:1 mole KOH:mole $LiAlSi_2O_6$). The lithium concentration in spodumene could vary from 0.01-4%.

The mixture was brought to a temperature of 400° C. and held for 1-16 hours to leach the lithium from beta-spodumene. Wet nitrogen gas was bubbled through the salt melt by first passing nitrogen through 1 L of DI water at 90° C. at a flow rate of between 1 to 10 SCFH. Over the course of the leaching 275 mL of water was passed into the molten salt suspension.

After the reaction had commenced, 9 g of the reacted mixture could be put into a nickel crucible and heated to 290° C. and about 0.5 g of CoO was added to the melt. The melt color changed from white to blue as the divalent cobalt ion was coordinated by hydroxide ions. After the added CoO was totally dissolved, aluminum foil was inserted into the melt and voltage pulses (0.8V vs cobalt reference, 100 ms pulse) were applied. Between pulses, there was an open circuit voltage period (ranging from 2 to 35 seconds). Repeated voltage pulses and OCV periods enabled a monolithic deposition of $LiCoO_2$ onto aluminum foil. After finishing the deposition, the $LiCoO_2$ electroplated onto the aluminum foil was taken out of the bath and rinsed with water after cooling down.

Example 9

To further demonstrate the operational principles of the technology, the lithium ion extraction and electrodeposition of lithium transition metal oxides according to Method 3 shown in FIG. 1 were conducted. Like Method 2, the alpha-spodumene was converted to beta-spodumene. The beta-spodumene was then roasted in sulfuric acid to produce a low purity (e.g., about 82.9%) $Li_2SO_4$ salts. Once the alpha-spodumene had been converted to the beta phase, it was very susceptible to chemical attack. When beta-spodumene is roasted in concentrated sulfuric acid between about 200° C. and about 300° C., but preferably about 250° C., protons from the acid can ionically exchange with the lithium in the spodumene (lithium aluminum silicate) yielding a low purity lithium sulfate. Lithium sulfate, however, is not a suitable precursor for commercial Li-ion cathode fabrication as the $SO_4^{2-}$ ion reacts deleteriously with the transition metal oxide during the standard high temperature synthesis (about 1000° C.) forming poorly crystalline lithiated transition metal oxides with unsuitable properties for most commercial energy storage applications.

While commercial synthesis cannot utilize lithium sulfate, molten salt electrodeposition was used to synthesize high purity lithiated transition metal oxides from lithium sulfate. Lithium sulfate can be mixed with KOH forming a eutectic solution. Transition metal(s) can then be added to the eutectic making it suitable for lithium transition metal oxide plating. Although this embodiment of the process has an additional processing step from alpha spodumene, the number of steps required to manufacture the lithiated transition metal oxides are reduced by at least 10 steps compared to conventional processes known in the art.

Figure 6A:
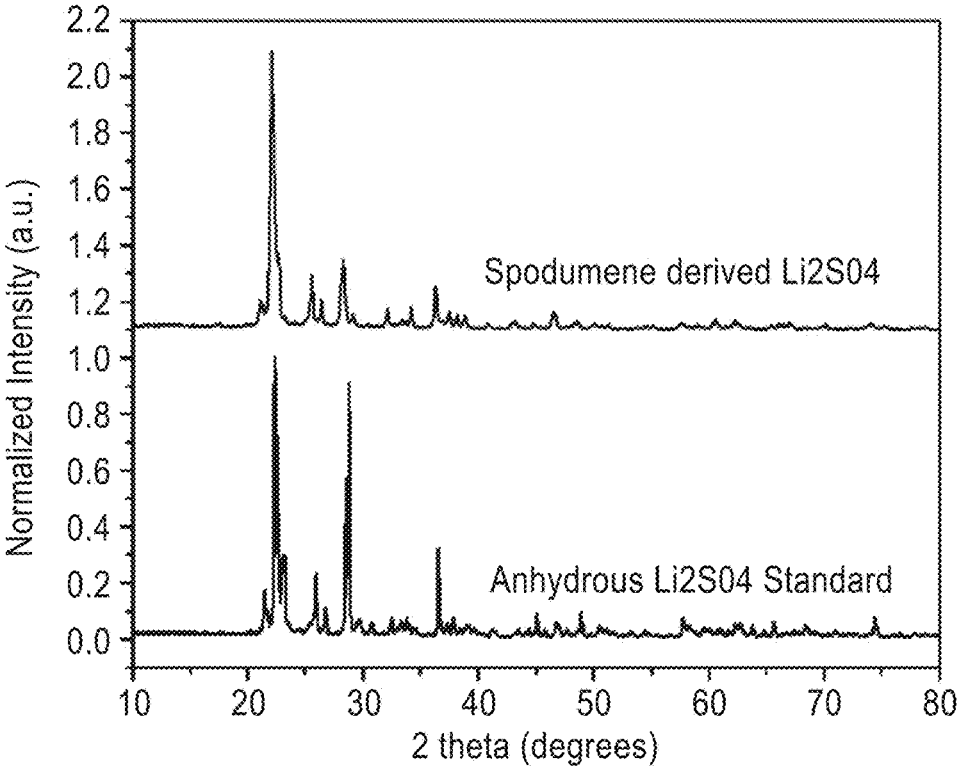
FIG. 6A is a graph of XRD results indicating that the sulfuric acid roast formed $Li_2SO_4$ as anticipated.
Figure 6B:
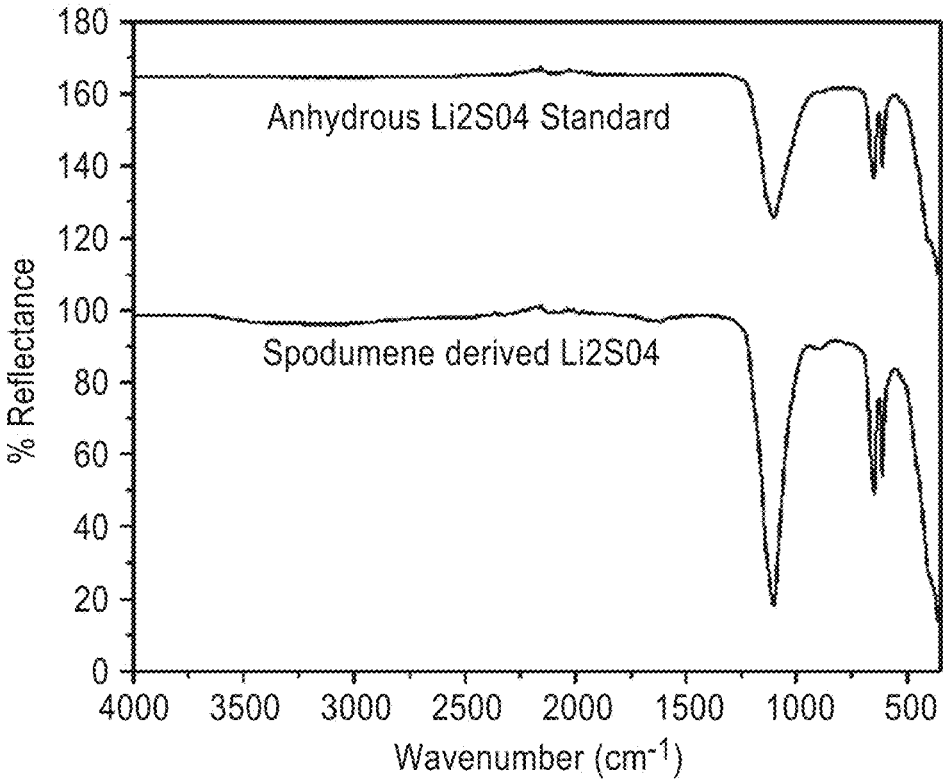
FIG. 6B is a graph of FTIR results of the sulfuric acid roast that formed $Li_2SO_4$ as expected.

The spodumene derived $Li_2SO_4$ was evaluated by XRD as shown in FIG. 6A and by FTIR as shown in FIG. 6B. The results of both indicating that the sulfuric acid roast formed $Li_2SO_4$ as expected. All peaks in the XRD labeled "spodumene derived $Li_2SO_4$" can be indexed to anhydrous lithium sulfate as shown by the good agreeance between the sulfuric acid roast sample and the anhydrous lithium sulfate reference sample (FIG. 6A). The FTIR spectrum shown in FIG. 6B also matches the peaks in the reference anhydrous lithium sulfate indicating that the sulfuric acid roast extraction process forms anhydrous lithium sulfate as expected. Consequently, lithium sulfate monohydrate is formed from the sulfuric acid roasting process, which is then dried using an organic solvent forming anhydrous lithium sulfate. The purity of the anhydrous lithium sulfate was 82.9% (metals basis ICP).

Anodic electroplating of a lithiated transition metal oxide from sulfuric roasted beta spodumene was also demonstrated. Here, 25 g of beta-spodumene was roasted in 140 mol % excess sulfuric acid at 250° C. for 30 minutes. After the reaction had finished, the products were immersed in $H_2O$. The solid material was then removed, and the remaining liquid was crystallized into $Li_2SO_4$ with 82.9% purity (metals basis ICP). A mixture of 0.375 g of the $Li_2SO_4$ feedstock and 8 g KOH were placed into a nickel crucible and heated to 370° C. followed by the addition of 0.5 g CoO to the melt. The melt color changed from white to blue as the divalent cobalt ion was coordinated by hydroxide ions.

After the added CoO was totally dissolved, aluminum foil was inserted into the melt and voltage pulses (0.8 V vs cobalt reference, 100 ms pulse) were applied. Between pulses, there was an open circuit voltage period (ranging from 2 to 35 seconds). No current was applied. Only open circuit voltage (OCV) was monitored. The cobalt ions in the depleted region close to the surface of aluminum foil were replenished by ion diffusion. Repeated voltage pulses and OCV periods enabled a monolithic deposition of $LiCoO_2$ onto the aluminum foil. After finishing deposition, the $LiCoO_2$ electroplated onto the aluminum foil was taken out of the bath and rinsed with water after cooling down.

Characterization of the LCO prepared by a sulfuric acid roast was conducted using scanning electron microscopy (FIG. 7C), X-ray diffraction (FIG. 7A) and electrochemical characterization (FIG. 7B) of $LiCoO_2$ electroplated from the resultant molten salt solution using constant current/constant voltage (CCCV) cycling. All diffraction peaks of the results shown in FIG. 7A could be assigned to JCPDS card no 50-0653 indicating that the materials made from $Li_2SO_4$ prepared by a sulfuric acid roast were crystallographically identical to lithium cobalt oxide produced using the standard commercial solid-state synthesis method.

Figure 7A:
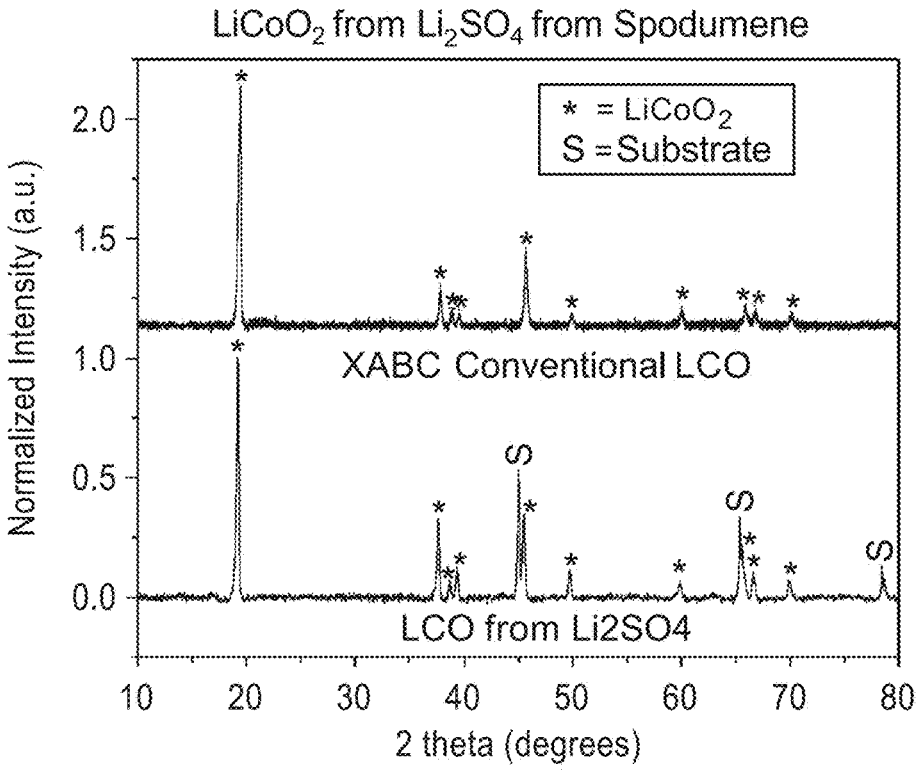
FIG. 7A is a graph of XRD results showing that the $Li_2SO_4$ can be directly used to electrodeposit $LiCoO_2$ cathode electrodes according to the presented technology.
Figure 7B:
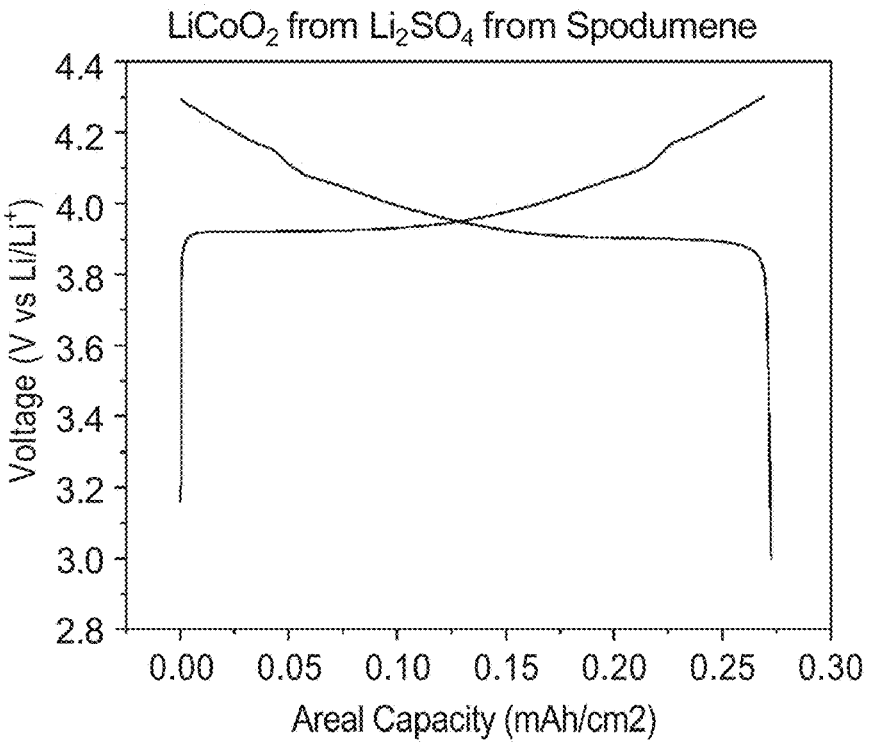
FIG. 7B is a graph of electrochemical characterization of $LiCoO_2$ electroplated from the resultant molten salt solution.
Figure 7C:
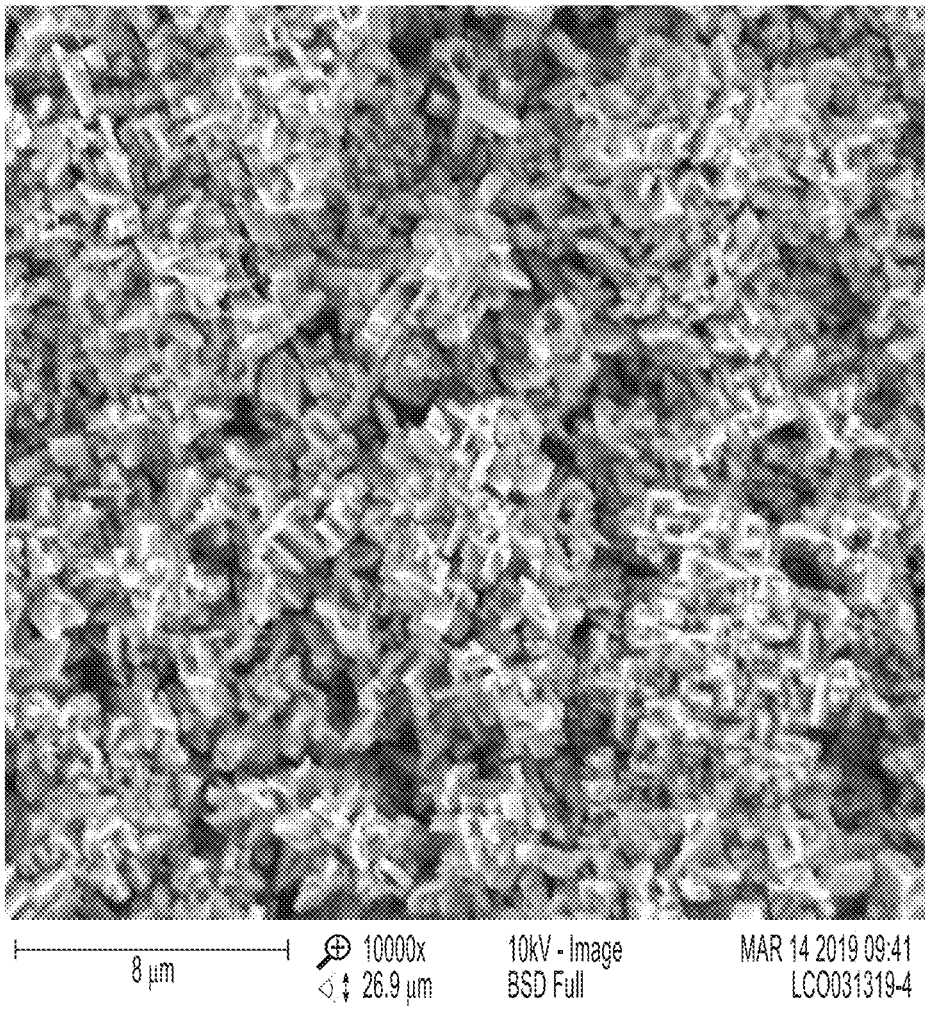
FIG. 7C is a micrograph of $Li_2SO_4$ prepared by a sulfuric acid roast.

The high-resolution scanning electron microscopy image of FIG. 7C shows highly faceted $LiCoO_2$ particles further underscoring the high crystallinity and quality of the lithium cobalt oxide made using this method. The LCO formed by this method was evaluated in a half cell coin cell using the LCO as a working electrode and a lithium metal counter electrode. The cell was cycled at a charge/discharge rate of C/4 between 4.3-3.0V vs $Li/Li^+$ at 22° C. The voltage vs. areal capacity curve of FIG. 7B demonstrates features that are consistent with high quality LCO. In particular the plateau ca. 4.2V vs $Li/Li^+$ is present, which is one indicative feature of commercially acceptable and high performing LCO (e.g. good cycle life, safety, and energy).

Figure 8A:
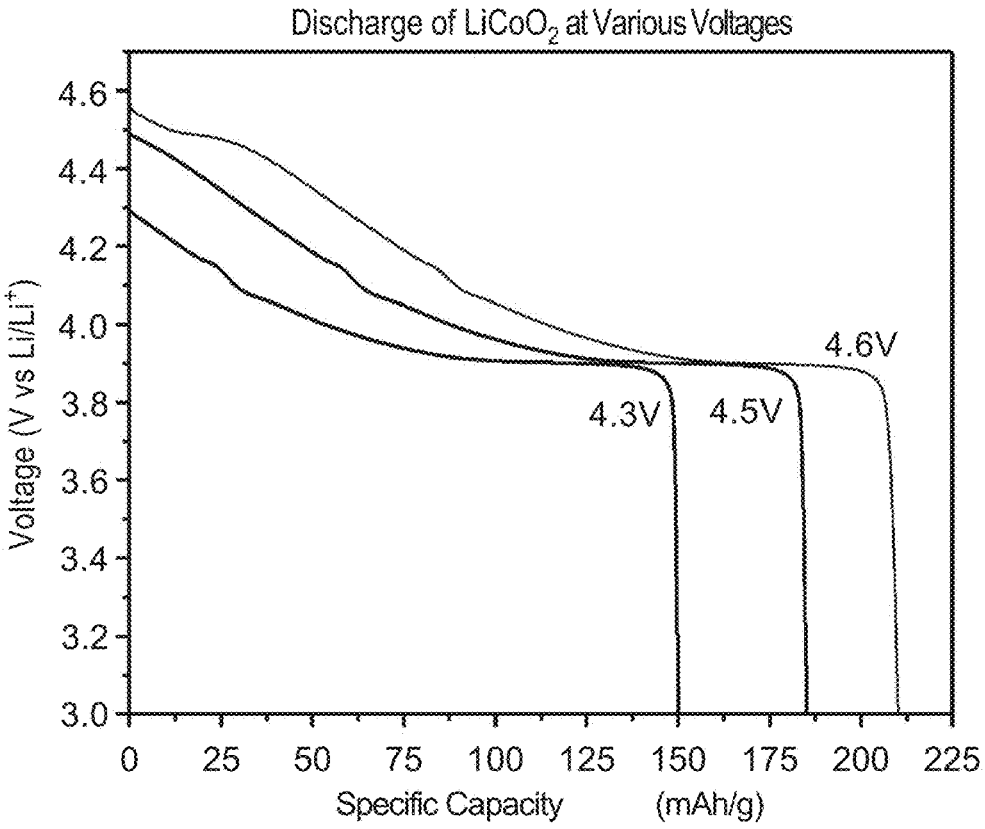
FIG. 8A is a graph of discharge voltages showing electrodeposited $LiCoO_2$ using $Li_2SO_4$ derived from spodumene can also be used as a high voltage cathode.
Figure 8B:
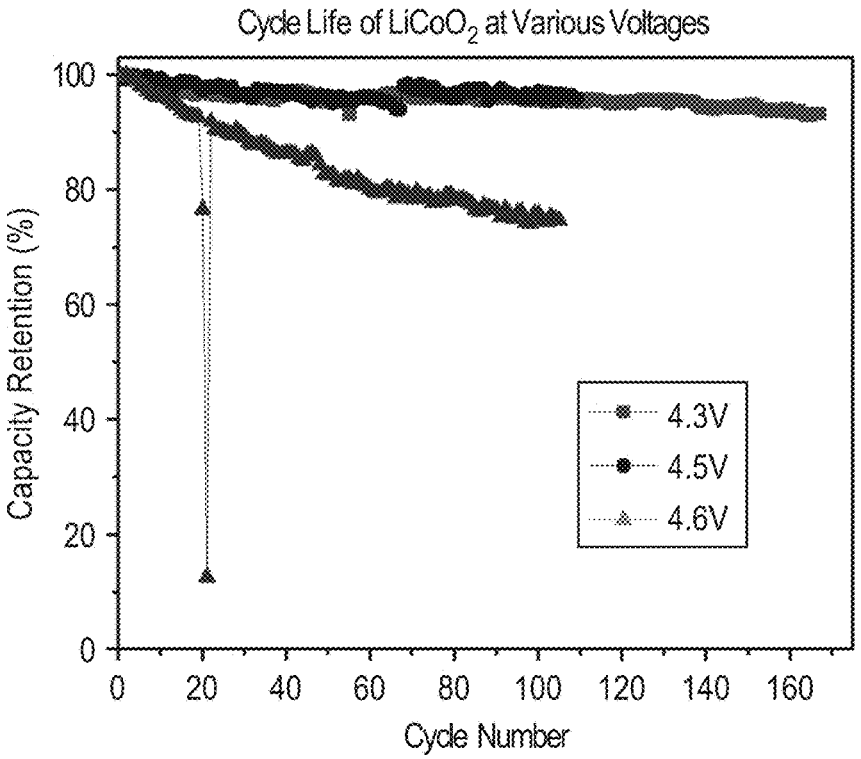
FIG. 8B is a graph of cycle life of $LiCoO_2$ used at various voltages.

The specific capacity and cycle life of $LiCoO_2$ evaluations are shown in FIG. 8A and FIG. 8B. These evaluations indicate that the electrodeposited $LiCoO_2$ using $Li_2SO_4$ derived from spodumene can also be used as a high voltage cathode.

High voltage cathodes are commercially important for their higher energy. However, deleterious effects can occur when the operating voltage of the cell is increased. To interrogate these correlations, the LCO formed by this method was evaluated in a half cell coin cell using the LCO as a working electrode and a lithium metal counter electrode. The cell was cycled at a charge/discharge rate of C/4 between 4.5-3.0V vs $Li/Li^+$. When the half-cell voltage was increased from 4.3 to 4.5V vs $Li/Li^+$, there is an increase in the specific capacity (150 to 185 mAh/g) and an increase in average voltage (3.9V to 4.05V vs $Li/Li^+$) leading to a large increase in energy. With this higher voltage charging, the cell still retains similar capacity to the 4.3V charge at >100 cycles, which may not be observed for common commercial materials that are not modified for high voltage cycling. This improved cycle life may originate from the characteristic physical properties of the electrodeposited materials.

Example 10

To further demonstrate the operational principles of the technology, the lithium ion extraction and electrodeposition of lithium transition metal oxides according to Method 4 shown in FIG. 1 were conducted. In this embodiment, lithium may be extracted from alpha spodumene (or beta) to produce various purities of LiOH for use in conventional purification methods, replacement of sulfuric acid roast extraction, and for industries other than Li-ion batteries; e.g. lithium for pharmaceuticals, high performance alloys, etc.

To illustrate Method 4, LiOH was extracted from alpha-spodumene in molten KOH through Method 1. The resultant molten salt, which contained the extracted lithium, was dissolved in water to solvate the LiOH and KOH while the residual spodumene powders were separated through gravity sedimentation. After filtering the solid precipitate, the solution was then dried and crystallized.

Figure 9:
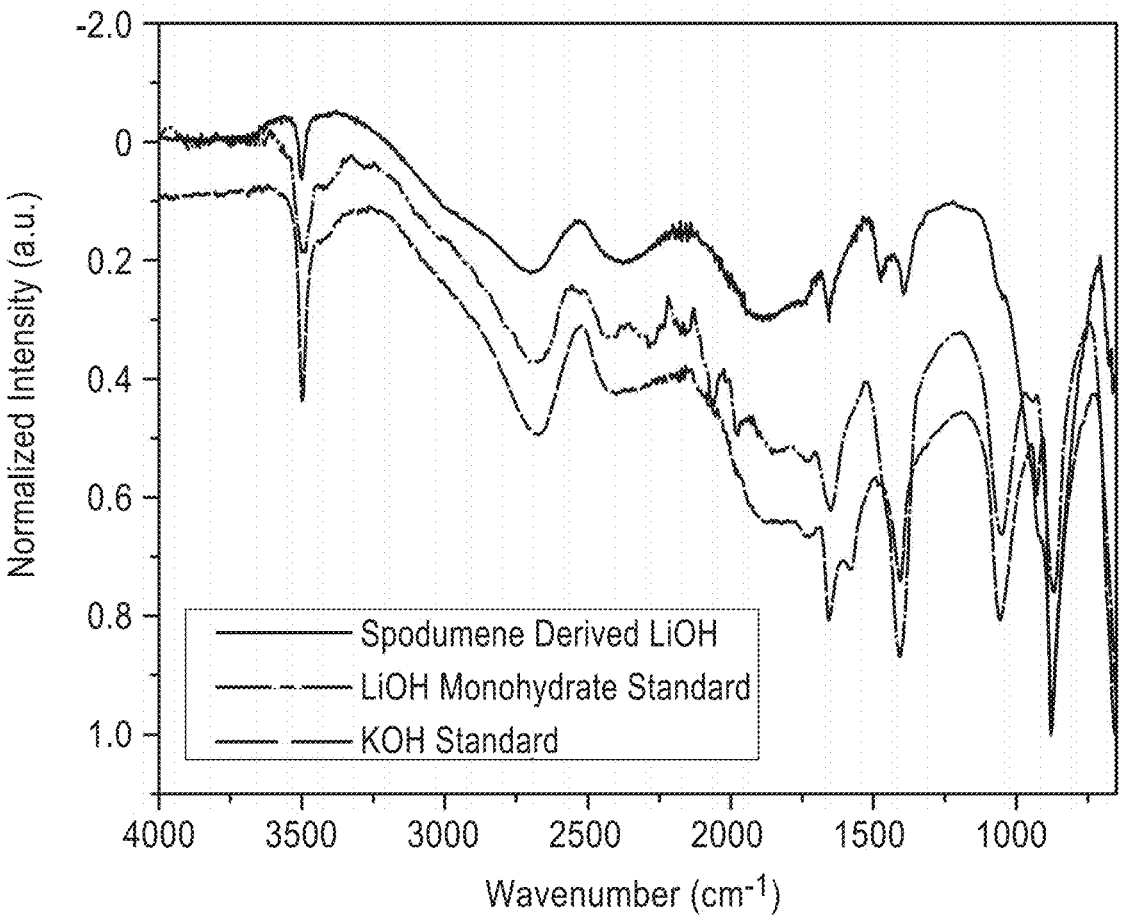
FIG. 9 is a graph of FTIR results showing that LiOH can be produced and isolated from alpha spodumene according to the present technology.

The FTIR spectrum of this intermediate crystalized material is shown in FIG. 9 indicating that it is KOH and LiOH are present as expected. Both LiOH and KOH have a similar bonding motif, and hence a majority of the peaks overlap. However, the peak at ca. 1450 $cm^{-1}$ is unique to LiOH indicating that LiOH is contained within this extract product.

To further isolate the LiOH from the KOH, the LiOH and KOH mixture was then separated using the boiling point difference between LiOH (924° C.) and KOH (1327° C.) or by solvent extraction using the disparities of solubilities of KOH and LiOH in different organic solvents such as alcohols. If the boiling point separation were used, the LiOH and KOH mixture was heated to 1025° C. for 2 hours using a Ni plate as a cold surface to collect the vaporized LiOH. Further isolation/and purification steps could be carried out to increase the purity to battery grade quality LiOH material (>99.5%). In addition, since Li metal reduction occurs at a much lower potential (−3.05 V vs SHE) than the impurities present in the extract solution, the impurities could be removed using a cathodic voltage hold. The action of this cathodic voltage hold would cause the impurities to plate out onto the working electrode while leaving the lithium to remain in the solution for isolation; albeit, with a higher starting purity that could reduce the number of downstream purification steps.

Example 11

Unprocessed cobalt ore, or lightly refined cobalt ore may also be used to synthesize high quality lithiated transition metal oxides and can be combined with aforementioned lithium sources (Methods 1-3), or high purity LiOH, $Li_2CO_3$ et al. using molten salts such as KOH and eutectics such as KOH:NaOH. Cobalt ore occurs in nature in many different mineral forms containing both copper or nickel and cobalt (e.g. carrollite ($Co_2CuS_4$), malachite ($Cu_2CO_3(OH)_2$ and heterogenite (CoO(OH))). Similar to alpha spodumene, metal impurities are also present which necessitate multi-step purification. In addition, cobalt occurs as the trivalent form, which is insoluble in the sulfuric acid leaching medium used to process this ore into usable materials. Therefore, a reducing agent is required to reduce the cobalt to the divalent state to become soluble (Minerals Engineering 111 (2017) 47-54). Cobalt ores, or lightly refined cobalt ores (after processing with sulfuric acid commercially) could be used as a starting material for electroplating transition metal oxides as described below.

Anodic electroplating of a lithiated transition metal oxide ($LiCoO_2$) from lightly refined cobalt ore (about 30% cobalt) was conducted. Lithium was extracted from alpha spodumene into KOH as described in Example 1. A 160 g portion of that lithium containing KOH was placed into a nickel crucible and heated to 370° C. To that mixture, 10 g of the lightly refined cobalt ore was added to the melt. The melt color changed from white to blue as the divalent cobalt ion was coordinated by hydroxide ions. After the added lightly refined cobalt ore was totally dissolved, aluminum foil was inserted into the melt and voltage pulses (0.8V vs cobalt reference, 100 ms pulse) were applied. Between pulses, there was an open circuit voltage period (ranging from 2 to 35 seconds). No current was applied. Only open circuit voltage (OCV) was monitored. The cobalt ions in the depleted region close to the surface of aluminum foil were replenished by ion diffusion. Repeated voltage pulses and OCV periods enabled a monolithic deposition of $LiCoO_2$ onto the aluminum foil. After finishing deposition, the $LiCoO_2$ electroplated onto the aluminum foil was taken out of the bath and rinsed with water after cooling down.

Figure 10A:
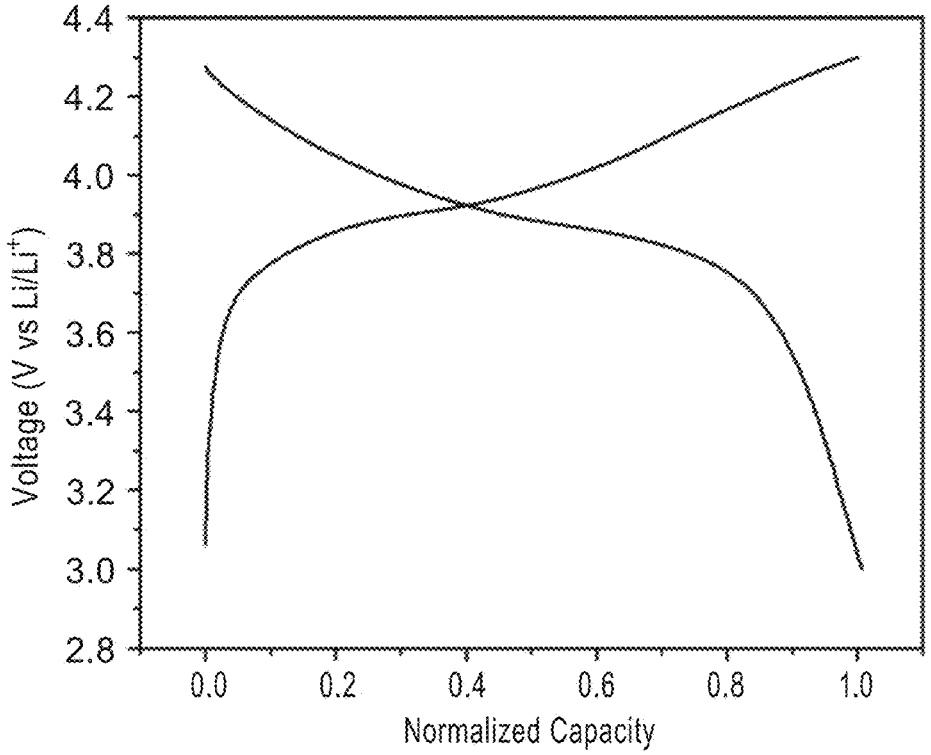
FIG. 10A is a graph of voltage vs. normalized capacity curves electrochemical characterization of electrodeposited $LiCoO_2$ on cathode electrodes.
Figure 10B:
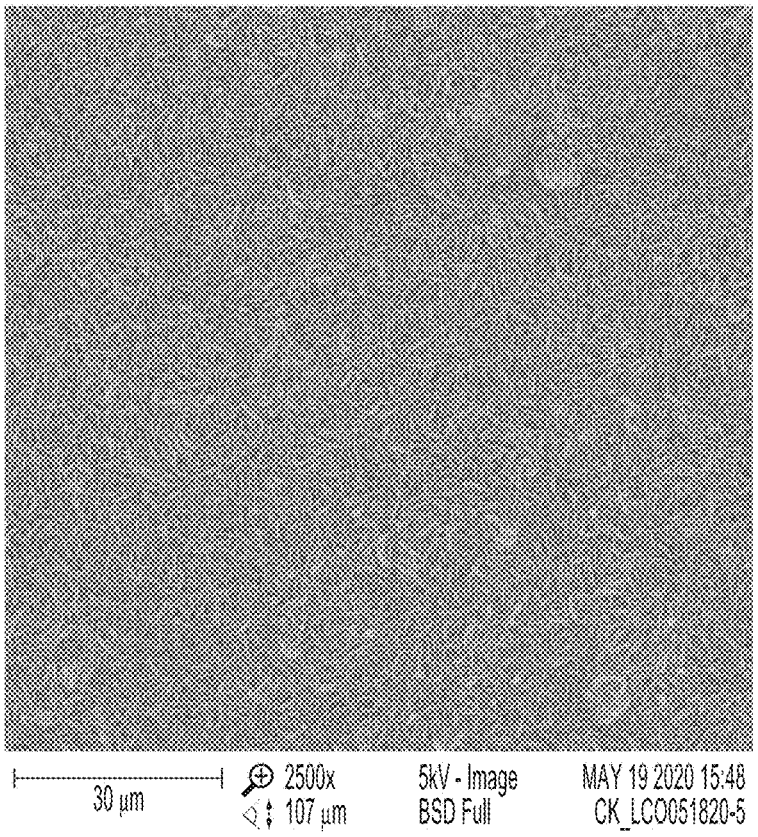
FIG. 10B is a micrograph of electrodeposit $LiCoO_2$ cathode electrodes.
Figure 10C:
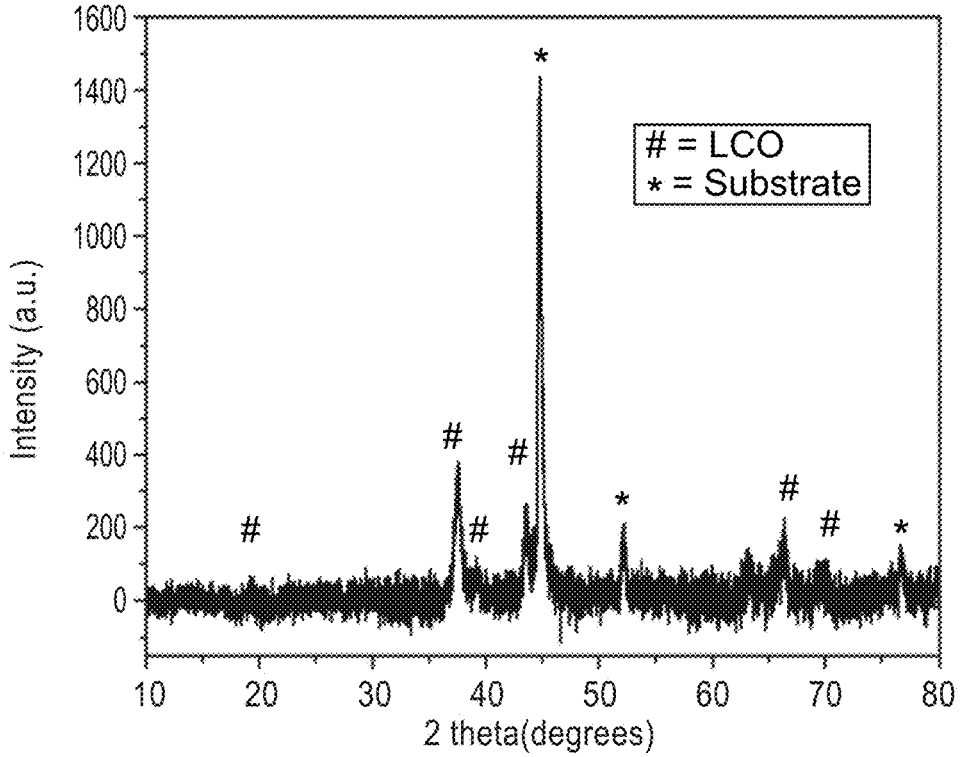
FIG. 10C is graph of XRD results showing that the alpha spodumene and lightly refined ore can be directly used to electrodeposit $LiCoO_2$ cathode electrodes according to the presented technology.
Figure 10D:
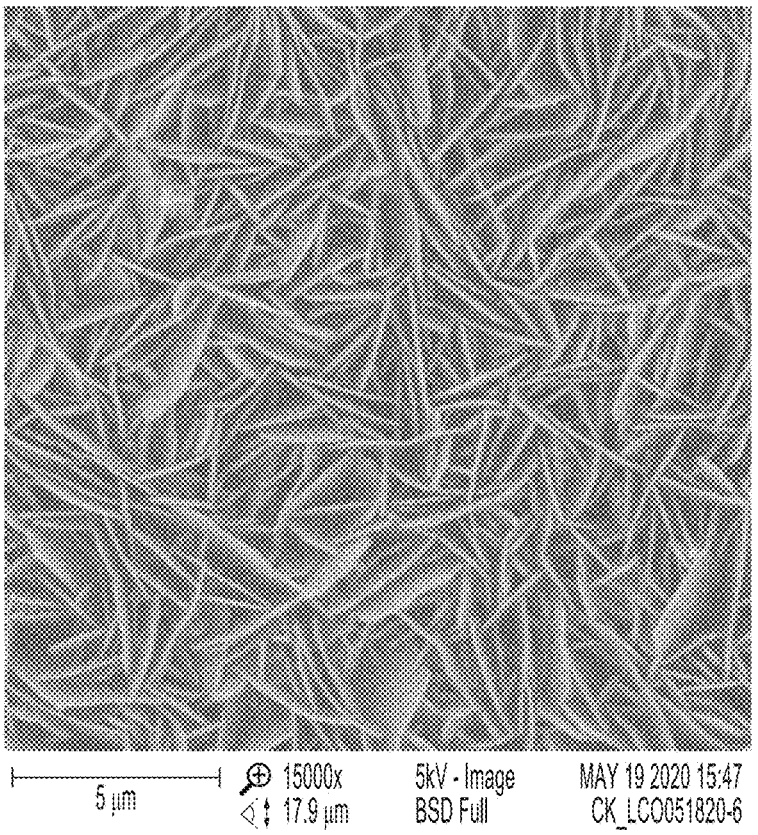
FIG. 10D is a micrograph of electrodeposited $LiCoO_2$ showing a flake morphology.

FIG. 10A through FIG. 10D shows the structural and electrochemical characterization of $LiCoO_2$ electroplated from the resultant molten salt solution. The major diffraction peaks shown in FIG. 10C can be assigned to JCPDS card no 50-0653 indicating that the materials made from alpha spodumene derived lithium precursor and lightly refined cobalt ore are crystallographically consistent to lithium cobalt oxide produced using the standard commercial solid-state synthesis method. The high-resolution scanning electron microscopy image of FIG. 10B and FIG. 10D shows the $LiCoO_2$ exhibits a flake-like morphology consistent with morphology that can be produced from high purity (>99.5) precursors such as LiOH and CoO.

The LCO formed by this method was evaluated in a half cell coin cell using the LCO as a working electrode and a lithium metal counter electrode and the results are shown in FIG. 10A. The cell was cycled at a charge/discharge rate of C/3 between 4.3-3.0V vs $Li/Li^+$ at 22° C. using constant current/constant voltage (CCCV) cycling. The voltage vs. normalized capacity curve demonstrates features that are consistent with LCO.

Example 12

Unprocessed nickel ore may also be to synthesize high quality lithiated transition metal oxides and can be combined with aforementioned lithium sources (Methods 1-3), or high purity LiOH, $Li_2CO_3$ et al. using molten salts such as KOH, or low purity Li precursors.

Electroplating a lithiated transition metal oxide ($LiNiO_2$) from Ni ore was demonstrated with unprocessed Nickel ore such as Garnierite ($Ni_3MgSi_6O_{15}(OH)_2$-$6(H_2O)$) that could be subjected to a similar leaching process as alpha spodumene. In this example, 833.6 g of garnierite was suspended in 1000 g of KOH (16 mol KOH:1 mol garnierite) and heated beyond the melting of the salt (400° C. to 1100° C.) to form a liquid-braunite solid molten salt suspension that was reacted for 1 to 16 hours.

Wet (or dry) nitrogen gas was bubbled through the salt melt by first passing nitrogen through 1 L of DI water at 90° C. at a flow rate of 1-10 SCFH. The molten salt could have sufficient chemical potential to break the covalent braunite bonds leading to the solubilization nickel into the molten KOH. The solution would turn blue as divalent nickel was coordinated by hydroxide ions. After the reaction commenced, 9 g of the reacted mixture was taken and put into a nickel crucible and heated to 370° C. Then 0.375 g of the aforementioned lithium sources (e.g. Methods 1-3), or high purity LiOH, $Li_2CO_3$ etc. may be added to the nickel rich KOH melt. Aluminum foil was inserted into the melt and voltage pulses (0.8V vs cobalt reference, 100 ms pulse) were applied. Between pulses, an open circuit voltage period (ranging from 2 to 35 seconds) was provided. Repeated voltage pulses and OCV periods enabled a monolithic deposition of $LiNiO_2$ onto the aluminum foil. After finishing deposition, the $LiNiO_2$ electroplated onto the aluminum foil was taken out of the bath and rinsed with water after cooling down.

Example 13

Unprocessed manganese ore can also be to synthesize high quality lithiated transition metal oxides and can be combined with aforementioned lithium sources (Methods 1-3), or high purity LiOH, $Li_2CO_3$ etc. sources using molten salts such as KOH or low purity Li precursors. In this illustration, lithiated transition metal oxide ($LiMn_2O_4$) from manganese ore was electroplated. Unprocessed Manganese ore, such as braunite ($Mn^{2+}Mn^{3+}{}_6(O_8)(SiO_4)$), was subject to a similar leaching process as used with alpha-spodumene. Here, 671.2 g of braunite was suspended in 1000 g of KOH (16 mol KOH:1 mol braunite) and heated beyond the melting of the salt (400° C. to 1100° C.) to form a liquid-braunite solid molten salt suspension that was reacted for 1 to 16 hours. Wet nitrogen gas was then bubbled through the salt melt by first passing nitrogen through 1 L of DI water at 90° C. at a flow rate of 1-10 SCFH. The molten salt should have sufficient chemical potential to break the covalent braunite bonds leading to the solubilization of silicon and importantly manganese into the molten KOH.

The solution turned yellow as divalent manganese was coordinated by hydroxide ions. After the reaction would commence, 9 g of the reacted mixture could be taken and put into a nickel crucible and heated to 370° C. 0.375 g aforementioned lithium sources (e.g. Methods 1-3), or high purity LiOH, $Li_2CO_3$ etc. may be added to the manganese rich KOH melt. Aluminum foil was then inserted into the melt and voltage pulses (0.8 V vs cobalt reference, 100 ms pulse) were applied. Between pulses, an open circuit voltage period (ranging from 2 to 35 seconds) was provided. Repeated voltage pulses and OCV periods enabled a monolithic deposition of $LiMn_2O_4$ onto the aluminum foil. After finishing deposition, the $Li_2MnO_4$ electroplated onto the aluminum foil was taken out of the bath and rinsed with water after cooling down.

Example 14

Combinations of unprocessed cobalt, manganese, and cobalt ore can also be used to synthesize high quality lithiated transition metal oxides such as $LiNiCoAlO_2$ and $LiNiMnCoO_2$ known as NMC 111, 622, 811, etc., related to the molar ratios of the transition metals in the oxide. Electrodeposition of a lithiated transition metal oxide (NMC/NCA) from cobalt was demonstrated with a combination of unprocessed nickel ore i.e. Garnierite ($Ni_3MgSi_6O_{15}(OH)_2$-$6(H_2O)$), unprocessed manganese ore i.e. braunite ($Mn^{2+}Mn^{3+}{}_6(O_8)(SiO_4)$), and lightly processed cobalt ore heterogenite (CoO(OH) that was subjected to a similar leaching process as alpha spodumene for NMC.

The ratios of the metal ores determine the NMC type such as NMC 111, 622, 811, etc. For example, NMC11 was made by mixing 277.8 g of garnierite, 223.7 g of braunite, and 102 g of heterogenite with 1000 g of KOH (16 mol KOH:0.33 mol garnierite, 0.33 mol braunite, and 1 mol heterogenite) and heating beyond the melting of the salt (400° C. to 1100° C.) to form a liquid-garnierite-braunite-heterogenite molten salt suspension that was reacted for 1 to 16 hours. Wet nitrogen gas was bubbled through the salt melt by first passing nitrogen through 1 L of DI water at 90° C. at a flow rate of 1 to 10 SCFH. The molten salt could have sufficient chemical potential to break the covalent garnierite, braunite, and heterogenite bonds leading to the solubilization of silicon and importantly nickel, manganese, and cobalt into the molten KOH.

After commencement of the reaction, 9 g of the reacted mixture was taken and put into a nickel crucible and heated to 370° C. Then 0.375 g of aforementioned lithium sources (e.g. Methods 1-3), or high purity LiOH, $Li_2CO_3$ etc. was added to the nickel, manganese, and cobalt rich KOH melt. Aluminum foil was inserted into the melt and voltage pulses (0.8V vs cobalt reference, 100 ms pulse) were applied. Between pulses, an open circuit voltage period (ranging from 2 to 35 seconds) was provided Repeated voltage pulses and OCV periods enabled a monolithic deposition of $LiNiMnCoO_2$ onto the aluminum foil. After finishing deposition, the $LiNiMnCoO_2$ electroplated onto the aluminum foil was taken out of the bath and rinsed with water after cooling down. To make NCA materials instead of NMC materials, the manganese ore could be replaced with an aluminum precursor.

Example 15

The electrolytic deposition of lithiated transition metal oxides produces the cathode material on the working, or positive electrode, while the metal of the hydroxide is plated on the anode, or negative, electrode. This allows the separation of non-lithium metals that may be present in the ores from the lithium. For example, cobalt containing ores typically also have copper or nickel contaminants that need to be removed before the ore is processed into a transition metal hydroxide, carbonate or oxide. However, in this process the molten salt can simultaneously dissolve the ore and be directly used to selectively refine high purity metals such as cobalt, copper, nickel, manganese etc. The selectivity arises from the fact that the reduction potentials of these metals are sufficiently different, that varying the reduction potential of the working vs. counter electrodes can selectively plate one metal before the others are plated. Once the one of the metals is completely plated or removed from the molten salt, the voltage can be reduced further, and the remaining metal can be removed resulting in selectivity and high purity. For example, a process flow diagram describing process flow embodiment 30 in which a metal ore such as a cobalt ore is used in combination with lithium containing ores, and low or high purity lithium salts is shown schematically in FIG. 11.

Figure 11:
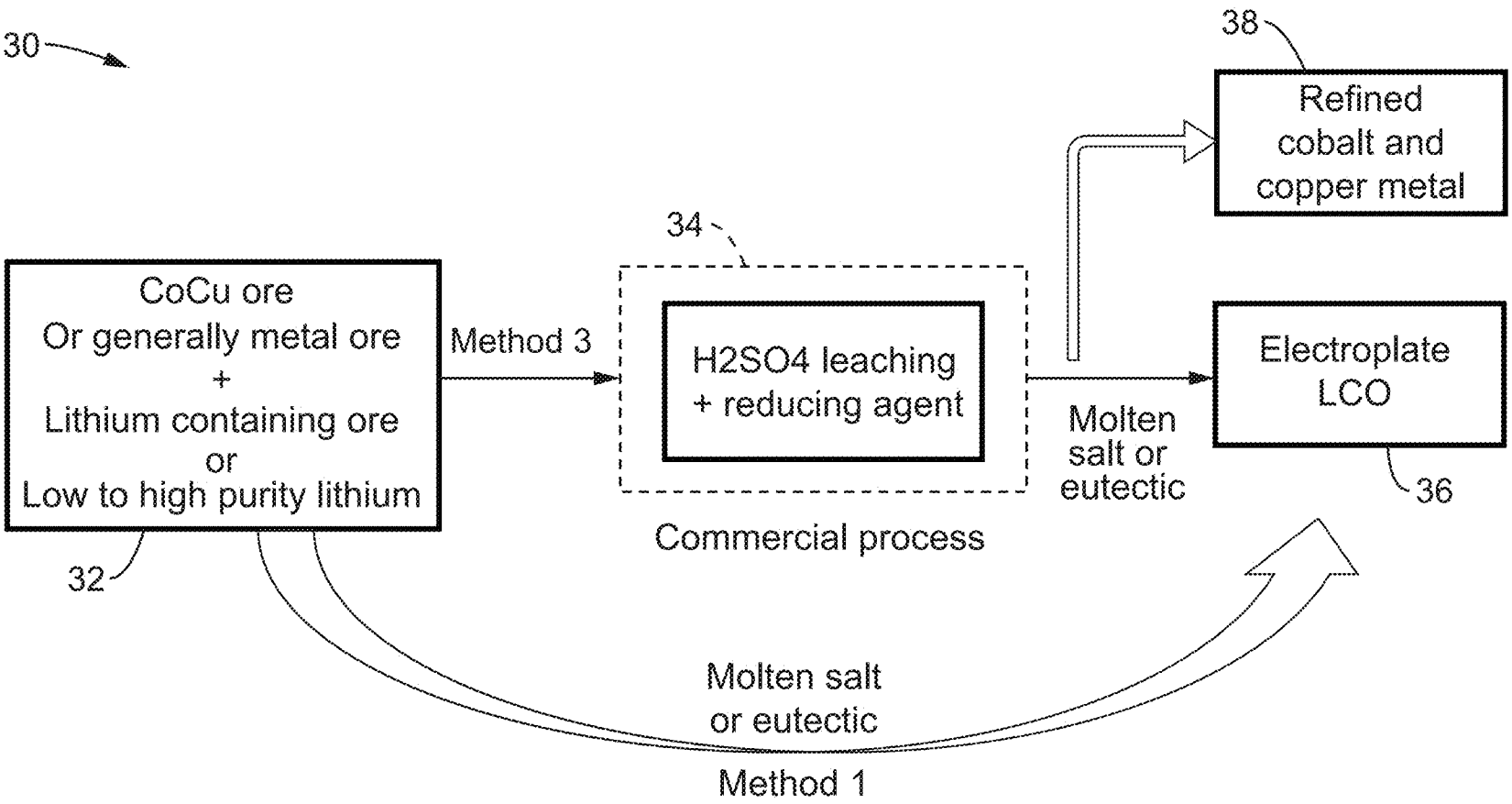
FIG. 11 is a block flow diagram describing a process according to an embodiment of the presented technology in which cobalt or more generally metal ore is used in combination with lithium containing ores, and low or high purity lithium salts to electroplate LCO.

In this illustration, a metal ore (e.g. CoCu), lithium containing ore and/or low to high lithium content salts are provided as a starting combination at block 32 of FIG. 11. Using a process like Method 3 discussed above, the ore combination can be subject to a conventional sulfuric acid roast at block 34 in this embodiment. The roasted materials from block 34 are then subject to the molten salt or eutectic process to selectively electroplate and refine the cobalt and copper metals of the mix at block 38. The removal of unwanted metals permits the efficient electroplating of the lithium materials on the electrode at block 36. Using the process like Method 1, discussed above, lithium transition metal oxides can be electroplated at block 36.

Example 16

Electrowinning is used commercially to synthesize lithium metal. This process can also be carried out using molten salts or eutectics to process lithium. A molten salt or eutectic as described herein can be used to extract the lithium from lithium containing minerals such as spodumene and then lithium metal can be directly produced from this extracted lithium molten salt mixture or through chemical exchange to a chloride-based eutectic commonly used by industry. Eutectic examples are: NaCl:KOH, KOH:KCl.

A method to extract lithium metal directly from alpha spodumene was demonstrated. In this illustration, 235 g of alpha spodumene concentrate with 3.36% Li by mass, was suspended in 1000 g of KOH (16:1 mole KOH:mole $LiAlSi_2O_6$), and heated beyond the melting point of the salt to form a liquid-spodumene-solid molten salt suspension (about 400° C. to about 1100° C.) where it was leached for 1-16 hours. Wet (or dry) nitrogen gas was bubbled through the salt melt by first passing nitrogen through 1 L of DI water at 90° C. at a flow rate 1-10 SCFH. Following this procedure, 160 g of the extraction mixture could be taken and put in a nickel crucible and heated to 400° C. in dry nitrogen to remove $H_2O$. Removing the $H_2O$ caused the dissolved aluminum and silicon to fall out of solution leaving potassium and lithium. If the $H_2O$ activity is low enough, lithium metal will become stable in the melt; otherwise, the lithium metal may spontaneously react with the water present in the molten salt causing it to dissolve.

If two platinum electrodes were submerged in the melt and a large enough cathodic potential was applied (<−3.05V vs SHE at 25° C.) between the electrodes, Li metal would form at the cathode and oxygen (or chlorine if a chloride salt is used) gas would be generated at the anode. Due to lithium's low density, it could float to the top of the salt where it could be skim-collected.

From the description herein, it will be appreciated that the present disclosure encompasses multiple embodiments which include, but are not limited to, the following:

A method for extracting lithium metal ions from a lithium containing ore or from lithium salts, the method comprising: (a) preparing a suspension of lithium containing ore or lithium salts in a hydroxide salt or eutectic; (b) heating the suspension to a temperature that exceeds the melting point of the hydroxide salt to produce a molten salt suspension of ore or lithium salt; (c) adding a source of transition metal ions; (d) electroplating the molten salt suspension to produce a lithiated transition metal oxide; and (e) isolating lithium metal ions from the lithiated transition metal oxide.

The method of any preceding or following embodiment, wherein the lithium containing ore comprises an alpha or beta lithium aluminum silicate (Spodumene).

The method of any preceding or following embodiment, wherein the lithium containing salts comprise LiOH or $Li_2CO_3$ with a purity of between 30% and 99.5%.

The method of any preceding or following embodiment, wherein the hydroxide salt is a salt selected from the group of hydroxide salts consisting of LiOH, KOH, NaOH, RbOH, CsOH, KOH:NaOH; KOH:NaCl, and KOH:KCl.

The method of any preceding or following embodiment, wherein the eutectic is selected from the group consisting of $LiNO_3$, $NaNO_3$, $KNO_3$, $LiNO_2$, $NaNO_2$ and $KNO_2$.

The method of any preceding or following embodiment, wherein the eutectic is selected from the group consisting of $Li_2SO_4$, $Na_2SO_4$ and $K_2SO_4$.

The method of any preceding or following embodiment, wherein the eutectic is selected from the group consisting of LiCl, NaCl, KCl, $AlCl_3$, ZnCl, LiBr, NaBr, KBr, LiF, KF and NaF.

The method of any preceding or following embodiment, further comprising: adding a second metal ore to the suspension of hydroxide salt and the lithium containing ore or lithium salt before heating.

The method of any preceding or following embodiment, wherein the second metal ore comprises an ore selected from the group of ores consisting of CoCu, $Co_2CuS_4$, and $(Cu_2CO_3(OH)_2$.

The method of any preceding or following embodiment, wherein the second metal ore comprises an ore selected from the group of ores consisting of garnierite, braunite, and heterogenite and mixtures thereof.

A method for extracting lithium metal ions from spodumene, the method comprising: (a) heating alpha spodumene to a temperature of approximately 1100° C. to convert alpha spodumene to beta spodumene; (b) preparing a suspension of beta spodumene in a eutectic; (c) heating the eutectic spodumene suspension to an elevated operation temperature; (d) electroplating the heated eutectic spodumene suspension to produce a lithiated transition metal oxide; and (e) isolating lithium metal from the oxide.

The method of any preceding or following embodiment, wherein the eutectic is selected from the group of consisting of KOH:NaOH; KOH:NaCl, and KOH:KCl.

The method of any preceding or following embodiment, further comprising: continuously adding beta spodumene to the heated eutectic spodumene suspension.

A method for extracting lithium metal ions from spodumene, the method comprising: (a) heating alpha spodumene to a temperature of approximately 1100° C. to convert alpha spodumene to beta spodumene; (b) roasting the beta spodumene with sulfuric acid; (c) preparing a suspension of roasted beta spodumene in a KOH molten salt or eutectic solution; (d) heating the eutectic spodumene suspension to an elevated operation temperature; (e) electroplating the heated eutectic spodumene suspension to produce a lithiated transition metal oxide; and (f) isolating lithium metal ions from the oxide.

The method of any preceding or following embodiment, wherein the roasting per 25 g of beta spodumene comprises: (a) adding 140% mole excess of theoretical value of sulfuric acid; (b) roasting at 250° C. for 30 minutes; and (c) extracting $Li_2SO_4$ with water.

A method for extracting lithium metal ions from a lithium containing ore or lithium salt, the method comprising: (a) preparing a suspension of lithium containing ore or lithium salts and a second metal ore in $H_2SO_4$; (b) roasting the suspension with sulfuric acid; (c) preparing a suspension of roasted suspension in a hydroxide salt; (d) heating the suspension to a temperature that exceeds the melting point of the hydroxide salt to produce a molten salt suspension of ore or lithium salt; (e) electroplating the molten salt suspension to produce a lithiated transition metal oxide; and (f) isolating lithium metal ions from the oxide.

The method of any preceding or following embodiment, wherein the lithium containing ore is an ore selected from the group consisting of lepidolite, petalite, amblygonite, hectorite, eucryptite, alpha-spodumene and beta-spodumene.

The method of any preceding or following embodiment, wherein the lithium containing salt is a salt selected from the group consisting of lithium chloride, lithium carbonate, lithium sulfide, lithium phosphate and lithium nitrate.

The method of any preceding or following embodiment, wherein the second metal ore comprises an ore selected from the group of ores consisting of garnierite, braunite, heterogenite, CoCu, $Co_2CuS_4$, and $(Cu_2CO_3(OH)_2$ ores.

The method of any preceding or following embodiment, wherein the hydroxide salt is a salt selected from the group of hydroxide salts consisting of KOH, NaOH, RbOH, and CsOH.

The method of any preceding or following embodiment, wherein the electroplated material is a material selected from the group of LMO, NCA, NMC, LFP, LTO, Ni, Co, and Mn.

A "foil" as used herein refers to a thin and pliable sheet of metal.

A "molten salt" as used herein is a salt in the liquid state comprising inorganic and/or organic ions.

When introducing elements of the present disclosure or the preferred embodiments(s) thereof, the articles "a", "an", "the" and "said" are intended to mean that there are one or more of the elements. The terms "comprising", "including" and "having" are intended to be inclusive and not exclusive (i.e., there may be other elements in addition to the recited elements). Additionally, the use of the singular includes the plural and plural encompasses singular, unless specifically stated otherwise. Furthermore, the use of "or" means "and/or" unless specifically stated otherwise.

As used herein, the singular terms "a," "an," and "the" may include plural referents unless the context clearly dictates otherwise. Reference to an object in the singular is not intended to mean "one and only one" unless explicitly so stated, but rather "one or more."

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A method for extracting lithium metal ions from a lithium containing ore or from lithium salts, the method comprising:

(a) preparing a suspension of lithium containing ore or lithium salts in a hydroxide salt or eutectic;

(b) adding a second lithium containing ore or lithium salt to the suspension of hydroxide salt and said lithium containing ore or lithium salt;

(c) heating the suspension to a temperature that exceeds the melting point of the hydroxide salt to produce a molten salt suspension of ore or lithium salt;

(d) adding a source of transition metal ions;

(e) electroplating the molten salt suspension to produce a lithiated transition metal oxide; and (f) isolating lithium metal ions from the heated suspension.

2. The method of claim 1, wherein the lithium containing ore comprises one or more ores selected from the group consisting of lepidolite, petalite, amblygonite, hectorite, eucryptite, alpha-spodumene, and beta-spodumene.

3. The method of claim 1, wherein the lithium containing salts comprise LiOH or $Li_2CO_3$ with a purity of between 30% and 99.5%.

4. The method of claim 1, wherein the hydroxide salt is a salt selected from the group of hydroxide salts consisting of LiOH, KOH, NaOH, RbOH, CsOH, KOH:NaOH, KOH:NaCl, and KOH:KCl.

5. The method of claim 1, wherein the eutectic is selected from the group consisting of $LiNO_3$, $NaNO_3$, $KNO_3$, $LiNO_2$, $NaNO_2$ and $KNO_2$.

6. The method of claim 1, wherein the eutectic is selected from the group consisting of $Li_2SO_4$, $Na_2SO_4$ and $K_2SO_4$.

7. The method of claim 1, wherein the eutectic is selected from the group consisting of LiCl, NaCl, KCl, $AlCl_3$, ZnCl, LiBr, NaBr, KBr, LiF, KF and NaF.

8. The method of claim 1, wherein the ore of a second metal comprises an ore selected from the group of ores consisting of CoCu, $Co_2CuS_4$, and $(Cu_2CO_3(OH)_2$.

9. The method of claim 1, wherein the ore of a second metal comprises an ore selected from the group of ores consisting of garnierite, braunite, and heterogenite and mixtures thereof.

* * * * *